US010696004B2

(12) United States Patent
Dettori et al.

(10) Patent No.: US 10,696,004 B2
(45) Date of Patent: Jun. 30, 2020

(54) EMBOSSING DEVICE AND METHOD

(71) Applicant: MTorres Tissue S.r.l., Lucca (IT)

(72) Inventors: Daniele Dettori, Capannori (IT); Gionata Pardini, Viareggio (IT)

(73) Assignee: MTORRES TISSUE S.R.L. (IT)

( * ) Notice: Subject to any disclaimer, the term of this patent is extended or adjusted under 35 U.S.C. 154(b) by 0 days.

(21) Appl. No.: 16/326,196

(22) PCT Filed: Aug. 4, 2017

(86) PCT No.: PCT/EP2017/069847
§ 371 (c)(1),
(2) Date: Feb. 16, 2019

(87) PCT Pub. No.: WO2018/036791
PCT Pub. Date: Mar. 1, 2018

(65) Prior Publication Data

US 2019/0193367 A1 Jun. 27, 2019

(30) Foreign Application Priority Data

Aug. 22, 2016 (IT) ..... 102016086446

(51) Int. Cl.
*B32B 37/00* (2006.01)
*B31F 1/07* (2006.01)

(52) U.S. Cl.
CPC ..... *B31F 1/07* (2013.01); *B31F 2201/0741* (2013.01); *B31F 2201/0743* (2013.01); *B31F 2201/0753* (2013.01); *B31F 2201/0764* (2013.01); *B31F 2201/0766* (2013.01); *B31F 2201/0776* (2013.01); *B31F 2201/0782* (2013.01)

(58) Field of Classification Search
CPC ..... B31F 1/07; B29C 66/814; B29C 66/22; B32B 7/05; Y10T 156/1737
USPC ..... 156/553, 581
See application file for complete search history.

(56) References Cited

U.S. PATENT DOCUMENTS

| | | | | |
|---|---|---|---|---|
| 5,736,223 | A | 4/1998 | Laurent | |
| 7,282,108 | B2 * | 10/2007 | Mansson | B31F 1/07 156/209 |
| 8,915,283 | B2 * | 12/2014 | Gelli | B31F 1/07 156/553 |
| 2010/0000687 | A1 | 1/2010 | Gelli et al. | |

FOREIGN PATENT DOCUMENTS

| | | | |
|---|---|---|---|
| EP | 2 095 935 | A1 | 9/2009 |
| WO | 2015/150452 | A1 | 10/2015 |

OTHER PUBLICATIONS

International Search Report and Written Opinion of the ISR (EP), PCT/EP2017/069847, 10 pages.

* cited by examiner

*Primary Examiner* — James D Sells
(74) *Attorney, Agent, or Firm* — Ware, Fressola, Maguire & Barber LLP

(57) ABSTRACT

An embossing device (1) includes three embossing rollers (5, 7, 9), each co-acting with a pressure roller (11, 15, 19), to emboss a plurality of paper plies (V1, V2, V3). Two embossing rollers can be easily interchanged to switch from a nested configuration to a tip-to-tip configuration, or to switch from one type of pattern to another. A lamination roller and a glue dispenser are arranged around one of the embossing rollers.

28 Claims, 11 Drawing Sheets

1
3
3B
3C
5
5A
5P
7
7A
7P
9
9A
9P
11
11A
11B
13
15
15A
15B
17
19
19A
19B
21
23
25
27
29
31
33
35
37
39
41
41A
41B
43
45
47
51
53
55
57
59
63
65
84
85
N
V1
V2
V3
V2+V3
IA
IB
IC
f31
f65

Fig.6A
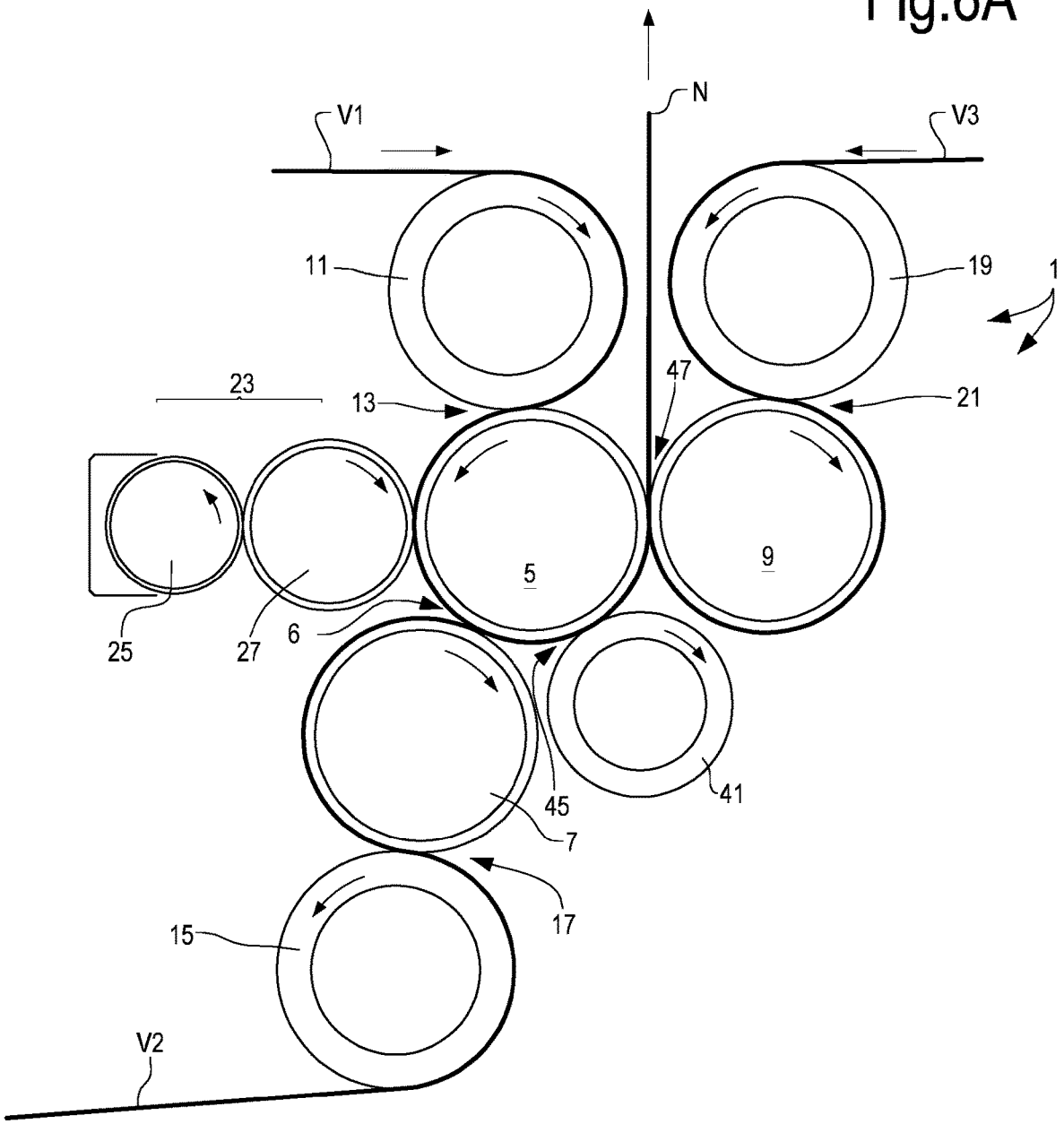
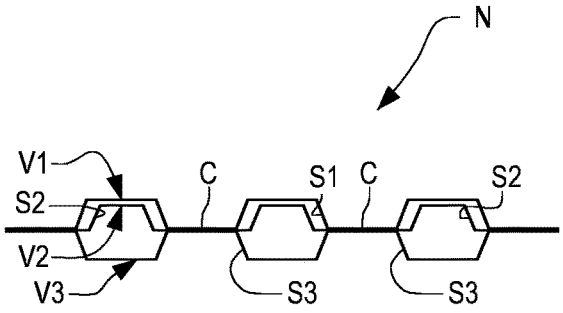
Fig.6B

Fig.6C
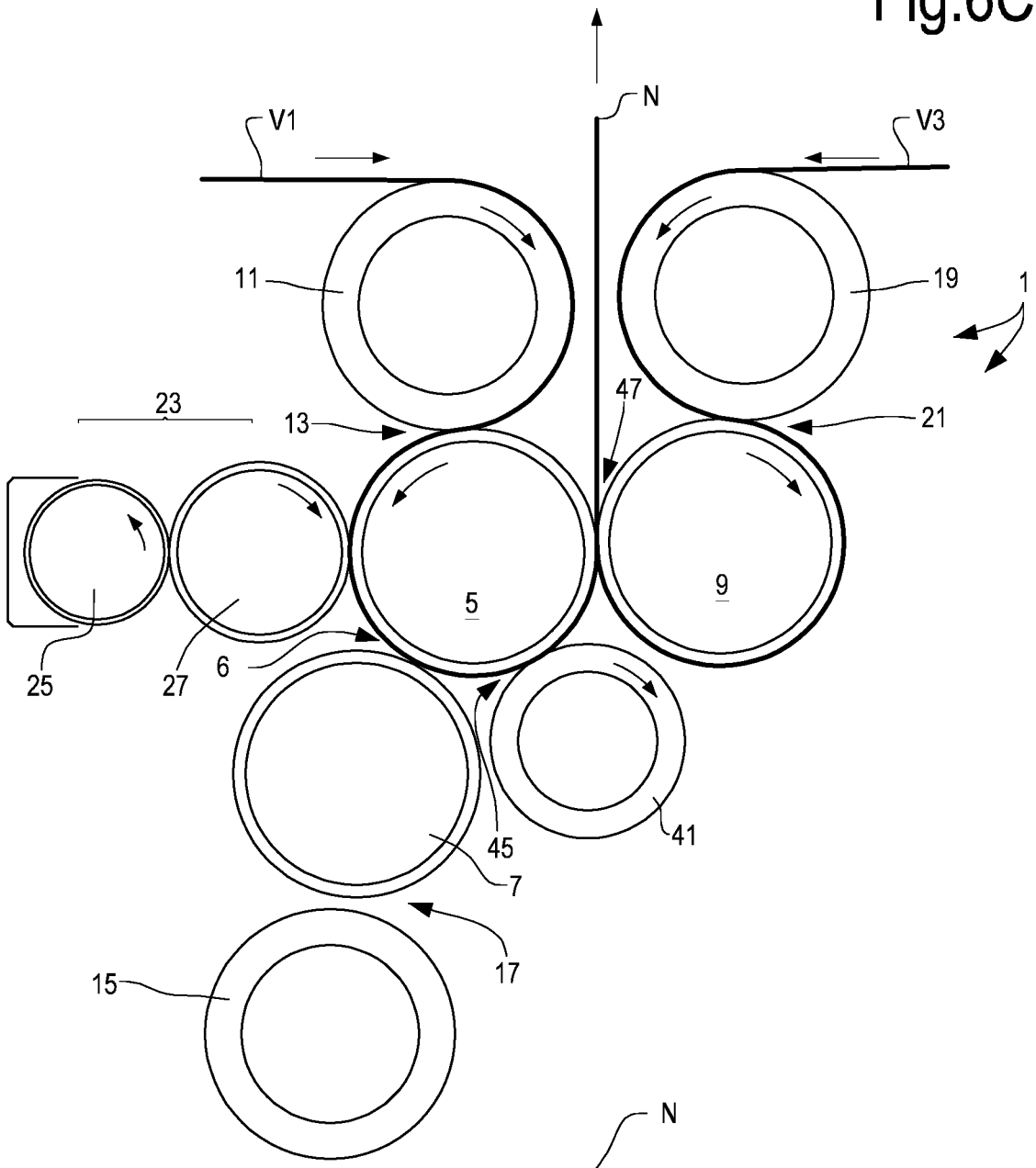
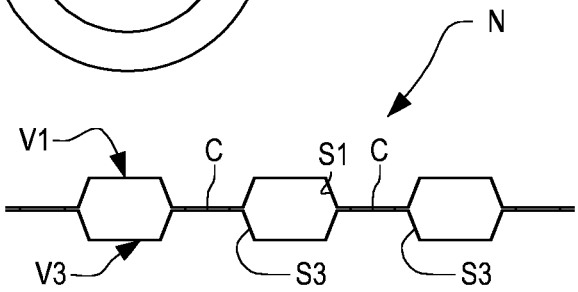
Fig.6D
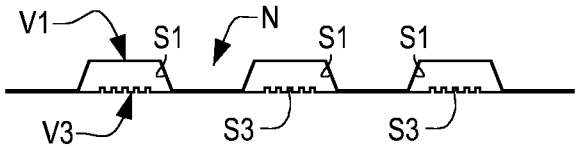
Fig.6E

EMBOSSING DEVICE AND METHOD

TECHNICAL FIELD

The invention relates to machines for paper converting, particularly but not exclusively for converting tissue paper for the production of toilet paper, kitchen towels and similar products. More specifically, the invention relates to embossing devices and embossing methods.

BACKGROUND ART

In the industry of manufacturing continuous sheets, such as webs of tissue paper or similar, for example to produce rolls of toilet paper, paper napkins, rolls of kitchen towels and similar, machines are used to emboss the cellulose web material, by means of which the originally smooth material is subjected to a permanent deformation resulting in the formation of embossed protrusions. Two or more plies of web material are usually embossed separately from one another and then bonded, using glue, with different mutual arrangements of the protrusions produced by embossing on the two or more plies. Generally speaking, the embossed plies are bonded using so-called tip-to-tip technology, or using a so-called nested technology, or using variants of these two base technologies.

In tip-to-tip technology, two embossed plies are bonded by bringing the protrusions of one ply into contact with the protrusions of the other ply. The two plies are glued by means of glue applied to the protrusion heads.

With nested technology, on the other hand, protrusions formed on one ply nest in the free spaces between the protrusions produced on the other ply. Glue is applied to the protrusions of one of the two plies to bond the two plies together.

In some cases more than two plies are bonded together, for example two outer embossed plies and one intermediate ply, which may be smooth or embossed as well.

To produce embossed plies bonded using tip-to-tip technology or nested technology, different machine and/or embossing rollers need to be used, specifically designed to allow bonding using one technique or the other.

For instance, U.S. Pat. No. 5,736,223 discloses an embossing device comprising a first embossing roller, a second embossing roller and a third embossing roller. Said embossing rollers co-act with respective first pressure roller, second pressure roller and third pressure roller. The arrangement is configured to manufacture a three-ply web, namely two external plies and in intermediate, internal ply. The two external plies are arranged and bonded to one another in a tip-to-tip configuration, while the intermediate ply is bonded in a nested configuration with one of the two external plies.

EP-A-2095935 discloses an embossing device comprising a double tip-to-tip embossing arrangement. Four embossing rollers and four pressure rollers are combined such as to emboss and laminate four plies to one another. This known embossing device is not suitable to manufacture nested plies.

Paper converting industries often require flexible machines, i.e. machines that can switch from the production of embossed plies using tip-to-tip technology, to the production of embossed plies using nested technology, and vice-versa, with the possibility of switching from one type of operation to the other quickly so as to meet constantly changing market needs, even for small batches.

There is therefore a need to provide embossing devices that are capable of producing multi-ply web material using one or other of the production techniques, and that can switch quickly and with a high degree of flexibility, by means of simple, easily-automated operations, from the production of one type of embossed material to the production of another type of embossed material.

SUMMARY OF THE INVENTION

According to one aspect, in order to fully or partially overcome one or more of the drawbacks of prior art machines, an embossing machine is proposed for producing a multi-ply web material, having at least two embossed plies bonded by gluing, comprising:

- a first embossing roller provided with first embossing protuberances;
- a first pressure roller forming with the first embossing roller a first embossing nip configured for receiving and embossing a first ply with first embossed protrusions of a first embossing pattern defined by the first embossing protuberances;
- a glue dispenser co-acting with the first embossing roller for applying glue to embossed protrusions of the first ply when the first ply is in contact with the first embossing roller;
- a second embossing roller provided with second embossing protuberances;
- a second pressure roller, forming with the second embossing roller a second embossing nip configured for receiving and embossing a second ply with second embossed protrusions of a second embossing pattern defined by the second embossing protuberances; wherein the first embossing roller and the second embossing roller form a first transfer nip for the embossed plies;
- a lamination roller co-acting with the first embossing roller and configured for laminating the first ply and the second ply between the lamination roller and the first embossing protuberances of the first embossing roller;
- a third embossing roller provided with third embossing protuberances;
- a third pressure roller, forming with the third embossing roller a third embossing nip configured for receiving and embossing a third ply with third embossed protrusions of a third embossing pattern defined by the third embossing protuberances; wherein the third embossing roller and the first embossing roller form a second transfer nip for embossed plies.

The first embossing roller, the second embossing roller, the respective first pressure roller and second pressure roller, together with the lamination roller, are configured and arranged so as to be able to produce a multi-ply material, for example with two plies, using a nested technique, DESL (Double Embossing Single Lamination), or DERL (Double Embossing Random Lamination). Each of the two plies is embossed separately from the other (whence the definition "double embossing"), in the two embossing nips formed by the first and second embossing roller and the respective first and second pressure roller. The two separately embossed plies are then laminated between one of the embossing rollers and the lamination roller. The first and second embossing roller can be easily removed and replaced in order to switch from a nested, DERL or DESL product, to another nested, DERL or DESL product, changing the pattern of one or both of the first embossing roller and the second embossing roller. The presence of the third embossing roller, which can be placed in a tip-to-tip position with the first embossing roller, makes it possible to produce a tip-to-tip type multi-ply material, without the need for any special mechanical intervention, by putting out of operation the second embossing roller. If necessary, the first embossing roller can be replaced to change the pattern of the tip-to-tip product. Alternatively, the embossing device disclosed herein can also produce a complex product with three plies, two of which are bonded by the nesting, DESL, or DERL technique while the third is bonded in a tip-to-tip manner with the first two.

A plurality of configurations of the embossing device intended to produce various types of material are shown by way of non-limiting example in detail below, with reference to the drawings for a better understanding of the multiple benefits of the embossing device according to the invention.

In some embodiments, the first embossing roller is supported in first seats of the embossing device. In practice, there are provided two seats for the two ends of the embossing roller, associate with the two opposing sides of the embossing device. Advantageously, each first seat has a movable portion, configured for taking, with respect to a fixed portion of the respective seat, a retention position of the first embossing roller and an open position, in which the first embossing roller can be removed from the first seats. The first embossing roller has two supporting journals, to which supporting bearings are fixed, which engage with the above-mentioned opening seats. Similarly, it is also possible that the second embossing roller is supported in second seats of the embossing device, in which support bearings are engaged fixed to the supporting journals of the second embossing roller.

Each second seat may advantageously have a movable portion, configured for taking, with respect to a fixed portion of the respective seat, a retention position of the second embossing roller and an open position, in which the second embossing roller can be removed from the second seats. To simplify the structure of the embossing device and make replacing one or the other of said first and second embossing roller faster, according to some embodiments the movable portions of the first seats and the movable portions of the second seats may be supported by a common movable unit, for simultaneously opening and closing the first seats and the second seats by means of a displacement of said movable unit.

The movable unit may in turn support the glue dispenser. In this way, a single movement (requiring a single actuator) can perform a threefold operation: distancing the glue dispenser from the first embossing roller; opening the first seats, to provide access to and remove the first embossing roller; opening the second seats to provide access to and remove the second embossing roller.

The two portions of each of the first seats and second seats may be configured so that when the seats are opened: the first embossing roller remains engaged with the fixed portions of the respective seats, solidly connected to the sides of the embossing device; the second embossing roller remains engaged with the movable portions of the respective second seats and is thereby distanced from the sides of the embossing device. This provides easier access to both the first and the second embossing roller for a transfer device, which can remove and replace the first embossing roller, or the second embossing roller, or both the first embossing roller and the second embossing roller.

According to advantageous embodiments, in order to simplify replacement of the first embossing roller, it may be provided that the first embossing roller is driven into rotation by a first flexible endless member, guided along a closed path and having an inner surface facing the interior of the closed path and an outer surface facing the exterior of the closed path. The outer surface of the first flexible member (preferably provided with teeth) may be in motion transmission contact with a first, preferably toothed driving wheel, torsionally coupled to the first embossing roller. In this way, the embossing roller may approach or move away from the flexible endless member. When the roller needs to be inserted in its working position, the driving wheel rests against the outer surface of the flexible endless member which, while the embossing roller is inserted into its support seat, partly wraps around the driving wheel. In the case of a toothed flexible member and a toothed driving wheel, the respective teeth engage with each other. When the embossing roller needs to be removed, the driving wheel is moved away from the outer surface of the flexible endless member. In both cases, it is not necessary to act on the transmission members, which on the contrary adapt by accompanying the mutual movement.

A similar arrangement may be provided for the second embossing roller.

The above-mentioned configuration of openable seats, in which the support bearings for the first and the second embossing roller are engaged, and their arrangement with respect to the glue dispenser, can also be adopted in an embossing device with only two embossing rollers and without a third embossing roller.

Therefore, according to a further aspect, an object of the invention is also an embossing device for producing a multi-ply web material, having at least two embossed plies bonded by gluing, comprising: a first embossing roller provided with first embossing protuberances; a first pressure roller forming with the first embossing roller a first embossing nip configured for receiving and embossing a first ply with first embossed protrusions of a first embossing pattern defined by the first embossing protuberances; a glue dispenser co-acting with the first embossing roller, for applying glue to embossed protrusions of the first ply when the first ply is in contact with the first embossing roller; a second embossing roller provided with second embossing protuberances; a second pressure roller, forming with the second embossing roller a second embossing nip configured for receiving and embossing a second ply with second embossed protrusions of a second embossing pattern defined by the second embossing protuberances; wherein the first embossing roller and the second embossing roller form a first transfer nip for the embossed plies. The embossing device may also comprise a lamination roller co-acting with the first embossing roller and configured for laminating the first ply and the second ply between the lamination roller and the first embossing protuberances of the first embossing roller. The embossing device is also provided with first seats for supporting the first embossing roller, each of which has a movable portion, configured for taking, with respect to a respective fixed portion, a retention position of the first embossing roller and an open position, in which the first embossing roller can be removed from the first seats. Furthermore, the embossing device has second seats for supporting the second embossing roller, each of which second seats has a movable portion, configured for taking, with respect to a corresponding portion, a retention position of the second embossing roller and an open position, in which the second embossing roller can be removed from the second seats. Furthermore, the movable portions of the first seats and the second seats are solidly connected to the glue dispenser, so as to move with it, the distancing movement of the glue dispenser causing the opening of the first seats and the second seats to support the first embossing roller and the second embossing roller. Furthermore, the first seats are configured so that the respective fixed portions, solidly connected to the sides of the embossing device, hold within them the first embossing roller, while the movable portions move away from the fixed portions. Vice-versa, the second seats are configured so that the respective movable portions, bound to the glue dispenser, hold within them the second embossing roller and translate it, moving it away from the first embossing roller, when the glue dispenser moves away from the first embossing roller.

According to another aspect, an object of the invention is a method for converting an embossing device from a first configuration to a second configuration, comprising the following steps:

A) providing an embossing system in a first configuration, comprising:
- a first embossing roller provided with first embossing protuberances,
- a first pressure roller, forming with the first embossing roller a first embossing nip configured for receiving and embossing a first ply with a first embossing pattern defined by the first embossing protuberances;
- a glue dispenser, co-acting with the first embossing roller for applying glue to embossed protrusions of the first ply when the first ply is in contact with the first embossing roller;
- a second embossing roller provided with second embossing protuberances;
- a second pressure roller, forming with the second embossing roller a second embossing nip configured for receiving and embossing a second ply with a second embossing pattern defined by the second embossing protuberances; wherein the first embossing roller and the second embossing roller form a first transfer nip for the embossed plies;
- a lamination roller co-acting with the first embossing roller and configured for laminating the first ply and the second ply between the lamination roller and the first embossing protuberances of the first embossing roller;
- a third embossing roller provided with third embossing protuberances and co-acting with a third pressure roller, forming with the third embossing roller a third embossing nip configured for receiving and embossing a third ply with a third embossing pattern defined by the third embossing protuberances; wherein the third embossing roller and the first embossing roller form a second transfer nip for the embossed plies;

B) replacing the first embossing roller with an alternative embossing roller; in which said step of replacing the first embossing roller with an alternative embossing roller comprises the following steps.
- temporarily moving the first pressure roller away from a working position in contact with the first embossing roller;
- removing the first embossing roller from the embossing system;
- introducing the alternative embossing roller in the position previously taken by the first embossing roller in the embossing system;
- returning the first pressure roller to its working position, in contact with the alternative embossing roller, forming with the alternative embossing roller the first embossing nip.

According to another aspect, there is provided a method for converting an embossing device from a first configuration to a second configuration, comprising the following steps:

A) providing an embossing system in a first configuration, comprising:
- a first embossing roller provided with first embossing protuberances;
- a first pressure roller, forming with the first embossing roller a first embossing nip configured for receiving and embossing a first ply with a first embossing pattern defined by the first embossing protuberances;
- a glue dispenser, co-acting with the first embossing roller for applying glue to embossed protrusions of the first ply when the first ply is in contact with the first embossing roller;
- a second embossing roller provided with second embossing protuberances;
- a second pressure roller, forming with the second embossing roller a second embossing nip configured for receiving and embossing a second ply with a second embossing pattern defined by the second embossing protuberances; wherein the first embossing roller and the second embossing roller form a first transfer nip for the embossed plies;
- a lamination roller co-acting with the first embossing roller and configured for laminating the first ply and the second ply between the lamination roller and the first embossing protuberances of the first embossing roller;
- a third embossing roller provided with third embossing protuberances and co-acting with a third pressure roller, forming with the third embossing roller a third embossing nip configured for receiving and embossing a third ply with a third embossing pattern defined by the third embossing protuberances; wherein the third embossing roller and the first embossing roller form a second transfer nip for the embossed plies;

B) replacing the second embossing roller with an alternative embossing roller; in which the step of replacing the second embossing roller with an alternative embossing roller comprises the following steps:
- temporarily moving the second pressure roller away from a working position in contact with the second embossing roller;
- removing the second embossing roller from the embossing system;
- introducing the alternative embossing roller in the position previously taken by the second embossing roller in the embossing system;
- returning the second pressure roller to its working position, in contact with the alternative embossing roller, forming with the alternative embossing roller the second embossing nip.

A further aspect of the invention disclosed herein concerns an embossing device with at least a first embossing roller, a second embossing roller, a first pressure roller co-acting with the first embossing roller and a second pressure roller co-acting with the second embossing roller, which system further comprises a substantially vertical storage unit, in which spare embossing rollers can be stored, for replacing one or the other of the working embossing rollers. The storage unit comprises a plurality of seats for embossing rollers, substantially mutually vertically superposed.

The term 'substantially vertical', in reference to the development of the embossing roller storage unit, in this context refers to a storage unit in which the various seats for the embossing rollers are located at different levels, i.e. at different heights from a base, for example from the base of the embossing device. In this sense, the seats do not have to be exactly superposed one above the other in a vertical line, but can be superposed, e.g. at different heights, but staggered horizontally, for example with a step-like arrangement.

The storage unit may be at a distance from the embossing area, where the embossing rollers temporarily in use are installed. For example, the storage unit may be placed upstream of the embossing area with respect to the direction in which the plies are fed to the embossing device. In advantageous embodiments, between the storage unit and the sides supporting the working embossing rollers, there is a passage for machine equipment or personnel.

In advantageous embodiments, this embossing device may be fitted with a transfer device that, on request and according to the various production needs, based on the configuration that the embossing device has to take, transfers the required embossing rollers to the machine and the unused rollers to the storage unit, and vice-versa. The transfer device may be movable along crossbeams arranged at a height higher than the embossing area where the working embossing rollers and the respective pressure rollers are located, together with the other members defining the ply path.

The transfer device may be movable along translation axes, for example a vertical axis and a horizontal axis. Advantageously, in some embodiments, movement along the two axes can be numerically controlled by means of suitable servo motors.

The transfer device may comprise a pair of arms ending with engagement hooks for engaging the embossing rollers. The engagement hooks may co-act with annular grooves idly mounted on supporting and rotating journals for the embossing rollers, to facilitate manipulation of the rollers. For example, at the two ends of the support and rotation journals of each embossing roller there may be mounted respective sleeves, idly supported on the respective journal of the embossing roller, said sleeves being provided with respective annular grooves, which may be provided with bevels to facilitate engagement by the hooks of the transfer device.

BRIEF DESCRIPTION OF DRAWINGS

An example of an embodiment of an embossing device and its various possible modes of use will be described in greater detail below, with reference to the accompanying drawings, wherein:

FIGS. 6A to 6I show different possibilities for passing plies of web material through the embossing device and diagrams of the products that can be obtained in the various configurations;

DETAILED DESCRIPTION OF EMBODIMENTS OF THE INVENTION

Figures 1, 1A, 1B, 1C:
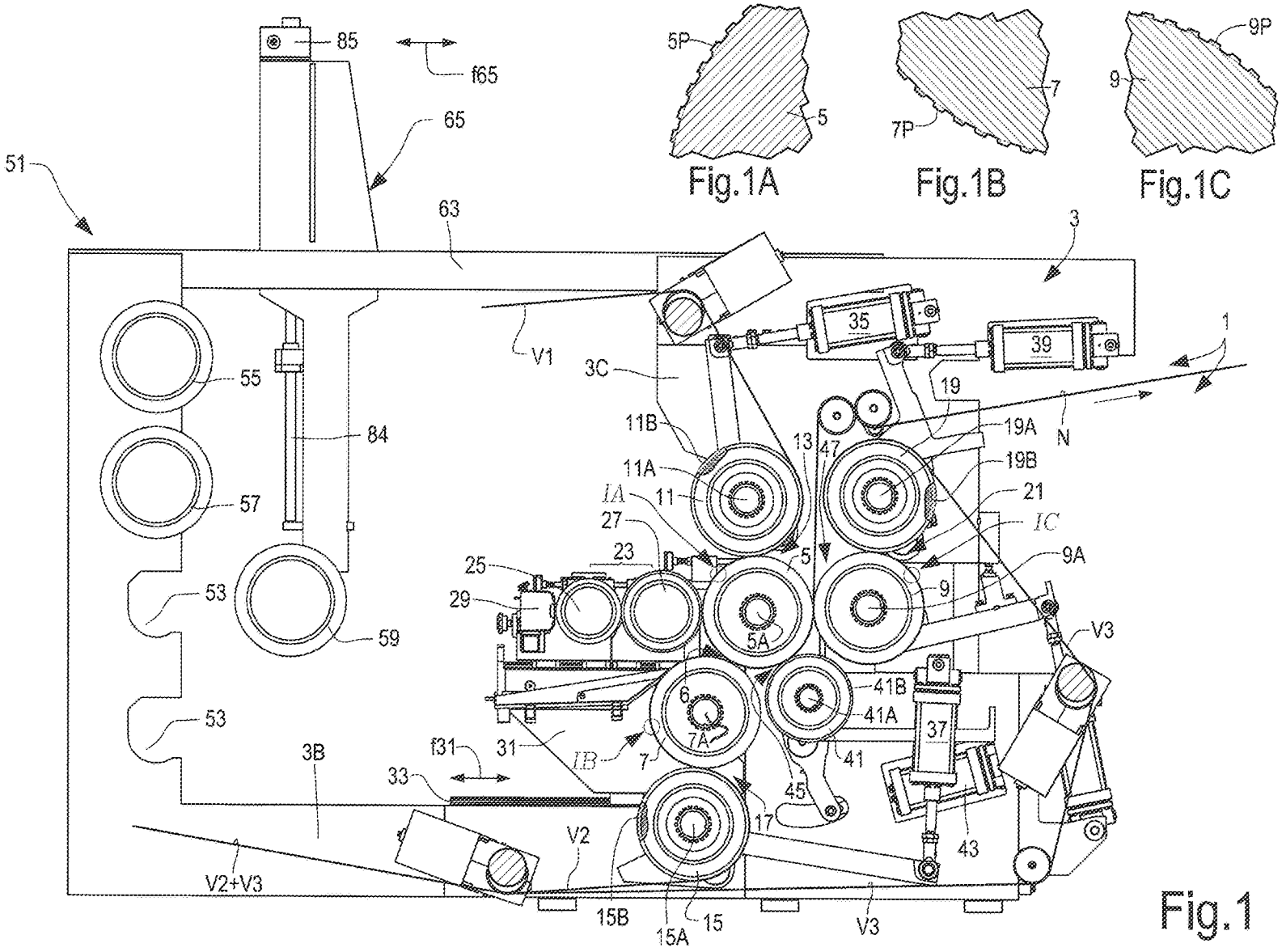
FIG. 1 shows a longitudinal cross-section along a vertical plane of an embossing device according to the invention.
FIGS. 1A, 1B and 1C show enlarged schematic details of three embossing rollers of the embossing device shown in FIG. 1

With initial reference to FIGS. 1 to 4, the general structure of an embossing device according to the invention will be described. The embossing device as a whole is indicated by the reference number 1 and may comprise a stationary bearing structure 3, for example provided with a base 3B, from which sides 3C, 3D (see FIGS. 1-3 and 4 respectively) extend.

Embossing rollers and pressure rollers are arranged between the two opposing sides 3C, 3D. The number of embossing rollers associated with an embossing device 1 may vary, so as to be able to set up the embossing device 1 in different ways, using a sub-set of available embossing rollers, for example in order to produce embossed web material with a different structure and configuration.

In general, in some embodiments of the embossing device disclosed herein, it is possible to change quickly the paths of the plies processed by the embossing device, for example to switch from the production of a tip-to-tip-type web material to a material bonded using the nested technique, or so-called DESL (Double Embossing Single Lamination), or even a so-called DERL (Double Embossing Random Lamination) product. In a product manufactured according to tip-to-tip bonding, two or more plies are embossed separately from one another and then bonded between two embossing rollers by pressing therebetween embossing protuberances belonging to the two embossing rollers. In a product made using the nested, DESL or DERL technique, the two plies are embossed separately and then bonded between one of the embossing rollers and a lamination roller. Depending on the mutual position between the embossed protrusions of the two plies, a distinction is made between nested, DESL and DERL. In general, in every case one of the two plies is removed from the embossing roller that embossed it and is placed on the other of the two embossing rollers on top of the other ply. In this way, both plies pass through an embossing nip formed between one of the two embossing rollers and the lamination roller.

As will become clear from the following description, a first advantage of the embodiment of an embossing device according to the present disclosure, is that it can facilitate the change of configuration from a configuration for the production for example of an embossed and tip-to-tip laminated multi-ply material, to an embossed multi-ply product laminated using the nested, DERL or DESL technique. The operations to be performed on the embossing device described below, which involve a change to the path of the plies as they pass through the embossing device, are substantially simpler and quicker than those required in prior art machines, which as known require not only roller replacement but also structural changes and the addition of other parts to the machine such as rubber-coated rollers, "bowed" rollers, arms for embossing rollers, etc. Another type of configuration change is associated with the type of pattern on the surface of the rollers, without needing to change the path of the plies inside the machine. This happens, for example, when one wants to switch from a DESL or nested embossing to a different type of DESL or nested embossing, changing the embossing pattern, but not the path of the plies in the embossing device. The embossing device disclosed herein facilitates this type of change.

FIGS. 1 to 4 describe a complex system, wherein the embossing device 1 is associated with six interchangeable embossing rollers, three of which are mounted in the embossing device between the sides 3C, 3D, and are already in the working position, while three of them are in a standing-by position waiting to be switched with the working rollers. As will be made clearer below, not all three embossing rollers arranged between the sides 3C, 3D necessarily need to be operational. There may be cases where only one or two of the embossing rollers is/are operational, while the other two or the third remain inactive.

The six embossing rollers may be variously combined with one another depending upon the various production needs, as will become clearer from the following description. There will be identified below a first embossing roller, a second embossing roller and a third embossing roller inside the embossing device 1, between the sides 3C and 3D. These first, second and third embossing rollers can change from one setup (or configuration) to another setup of the embossing device 1, in the sense that they can be replaced with other embossing rollers temporarily waiting in a storage unit for interchangeable rollers. Therefore, depending upon how many rollers are mounted on the embossing device 1, the first embossing roller, the second embossing roller or the third embossing roller may be different and variable as a function of the configuration and setup of the embossing device 1.

With particular reference to FIG. 1, the embossing device 1 comprises an embossing area between the sides 3C, 3D, wherein a first embossing roller 5, a second embossing roller 7 and a third embossing roller 9 are arranged. Between the first embossing roller 5 and the second embossing roller 7 a first transfer nip 6 for the passage of embossed plies is formed.

Each embossing roller 5, 7, 9 is provided with embossing protuberances, schematically shown in the detailed enlargements shown in FIGS. 1A, 1B and 1C. More specifically, embossing roller 5 comprises embossing protuberances 5P, embossing roller 7 comprises embossing protuberances 7P and embossing roller 9 comprises embossing protuberances 9P. The embossing protuberances 5P, 7P and 9P are made on the cylindrical surface of the respective embossing rollers 5, 7 and 9. The size, shape, distribution (spacing and density) of the embossing protuberances 5P, 7P and 9P varies from one embossing roller to another, depending on the type of embossing desired. The embossing protuberances 5P, 7P, 9P shown in FIGS. 1A, 1B and 1C are not shown to scale and are given purely by way of example.

During operation of the embossing device 1, the first embossing roller 5 provided with the first embossing protuberances 5P rotates around a rotation axis 5A and co-acts with a first pressure roller 11, rotating around a rotation axis 11A substantially parallel with the rotation axis 5A. The pressure roller 11 may be coated with a layer of elastically yielding material, schematically indicated by reference number 11B. The elastically yielding layer 11B may be made of rubber, synthetic rubber, or any other yielding material, preferably an elastically yielding material.

Between the first embossing roller 5 and the first pressure roller 11 a first embossing nip 13 is formed, through which the path of a first ply V1, for example a ply of cellulose fiber, such as a ply of tissue paper, extends. The ply V1 is embossed in the first embossing nip 13 due to the effect of the mutual pressure exerted between the first embossing roller 5 and the first pressure roller 11. As a result of said pressure, the protuberances 5P of the first embossing roller 5 penetrate into the thickness of the elastically yielding coating 11B covering the cylindrical surface of the first pressure roller 11.

Similarly, the second embossing roller 7, which rotates about a rotation axis 7A, substantially parallel to rotation axis 5A of the first embossing roller 5, co-acts with a second pressure roller 15 which, like the first pressure roller 11, may be coated with a layer of elastically yielding material 15B, for example rubber. The second pressure roller 15 rotates about a rotation axis 15A substantially parallel to rotation axis 7A of the second embossing roller 7. Between the second embossing roller 7 and the second pressure roller 15 a second embossing nip 17 is formed. A path for a second ply of cellulose material V2 may extend through the second embossing nip 17.

As will become clear from the following description, in some operating modes, both plies V1 and V2 are not necessarily present in the embossing device 1. For example, in some operating modes, the ply V2 may be omitted.

Furthermore, with reference to the above and to the description below, it must be understood that the plies may in turn be formed from two or more layers and may be delivered from a single reel or by several reels of cellulose material.

When present, the ply V2 is embossed, in other words it is permanently deformed in the embossing nip 17 due to the mutual pressure exerted between the second embossing roller 7 and the second pressure roller 15, said pressure causing penetration of the embossing protuberances 7P of the second embossing roller 7 into the elastically yielding material forming the coating 15B of the second embossing roller 15.

The third embossing roller 9 co-acts with a third pressure roller 19, rotating about a rotation axis 19A substantially parallel to a rotation axis 9A, about which the third embossing roller 9 rotates, and to the rotation axes 11A, 5A, 7A and 15A mentioned above.

The third pressure roller 19 may be coated with an elastically yielding material which forms a coating 19B, similar to coating 11B and coating 15B of the first pressure roller 11 and the second pressure roller 15. Reference number 21 designates a third embossing nip, formed between the third embossing roller 9 and the third pressure roller 19. A third ply of web material V3 may be fed along a third feed path through the third embossing nip 21 where the third ply V3 can be embossed, in other words permanently deformed due to the mutual pressure exerted between the third pressure roller 19 and the third embossing roller 9, said pressure causing penetration of the embossing protuberances 9P of the third embossing roller 9 into the elastically yielding material 19B of the third pressure roller 19.

A glue dispenser 23 co-acts with the first embossing roller 5, by applying glue to the embossed ply V1, when it comes into contact with the cylindrical surface of the first embossing roller 5. The glue is applied to the surface portions of the embossed ply V1 corresponding with some or all of the head surfaces of the embossing protuberances 5P of the first embossing roller 5. In some embodiments the glue dispenser 23 may comprise an anilox roller 25 and an applicator roller 27. The anilox roller 25 may draw the glue from a glue storage tank 29 and transfer it to the applicator roller 27. The latter transfers the glue received from the anilox roller 25 to the embossed ply V1.

The glue dispenser 23 may be mounted on a trolley, slide or other movable unit 31, sliding in the direction of the double arrow f31 on guides 33 constrained to the base 3B of the load-bearing structure 3 of the embossing device 1. This makes it possible to move the glue dispenser 23 towards and away from the first embossing roller 5 for reasons that will be made clear below.

Still with reference to FIG. 1, reference numbers 35, 37 and 39 indicate linear actuators, for example a hydraulic or pneumatic cylinder-piston, or electric actuators that, using suitable diverter arms, push the respective pressure rollers 11, 15 and 19 against the corresponding embossing rollers 5, 7 and 9.

The first embossing roller 5, together with the glue dispenser 23 and the first pressure roller 11, co-act with a lamination roller 41, which rotates about a rotation axis 41A substantially parallel with the rotation axis of the remaining rollers described above. The lamination roller 41 may be coated with an elastically yielding material, forming a coating layer 41B, or may be provided with a surface made of steel or another rigid material. The reference number 43 indicates an actuator configured for pushing the lamination roller 41 against the side cylindrical surface of the first embossing roller 5. Between the first embossing roller 5 and the lamination roller 41, a lamination nip 45 is formed, through which a web material can pass, formed for example by the pair of plies V1 and V2, superposed and guided around the first embossing roller 5.

Between the first embossing roller 5 and the third embossing roller 9, a nip 47 is formed for the passage of the embossed plies. A multi-ply product can pass through the nip 47, in the configuration shown in FIG. 1, and formed by bonding plies V1, V2 and V3. The multi-ply web material thus formed is indicated by the reference letter N. As will be made clearer below, the multi-ply web material N may also comprise a different number of plies, for example only plies V1 and V3.

The assembly of pressure rollers, embossing rollers, glue dispenser 23, and lamination roller 41 together constitute an embossing system.

The embossing device 1 may comprise a storage unit 51 which may contain a plurality of embossing rollers ready to be used to replace the embossing rollers 5, 7 and 9 temporarily mounted on the embossing device 1 between the sides 3C, 3D for processing the plies V1, V2 and V3. In the embodiment shown, the storage unit 51 is integrated into the embossing device 1, inasmuch as it is supported on the same base 3B that supports the sides 3C, 3D.

In other embodiments, not shown, the storage unit 51 may be separate from the actual embossing device 1 and may be placed at a distance therefrom.

The storage unit 51 may also be used in embossing devices other than the exemplary embodiment disclosed herein, for example in traditional tip-to-tip or nested type embossing units, or in embossing-gluing units, convertible embossing units, and in general any time it might be useful to have a store of interchangeable embossing rollers. Therefore, the features and embodiments shown herein of the storage unit 51 are independent from the specific characteristics of the embossing device.

The storage unit 51 may comprise a plurality of seats 53 specifically shaped to receive embossing rollers 55, 57, 59 that can be used to replace the embossing rollers supported by the sides 3C, 3D. As will be made clearer below, in practice the rollers in the storage unit 51 are provided to replace, preferably automatically, the embossing rollers 5 and 7, while the third embossing roller 9 may be fixed, i.e. not interchangeable, or interchangeable only by means of more complex, less frequent maneuvers.

In the embodiment shown, four seats are provided to support interchangeable embossing rollers, but it must be understood that the number of embossing rollers that can be housed in the storage unit 51 may be different, by providing a greater or lower number of seats 53. One of the seats of the storage unit 51 remains empty to allow replacement of the embossing rollers 5, 7.

Advantageously, in the example shown, the seats 53 of the storage unit 51 are vertically superposed, i.e. the storage unit 51 develops substantially in height, in other words it develops vertically. As shown in the accompanying drawings, the storage unit 51 is integrated into the embossing device, in the sense that it can be connected to the same load-bearing structure, typically the same base 3B.

Preferably, the storage unit 51 is at a distance from the embossing rollers that are in the working position (i.e. those temporarily supported between the sides 3C, 3D). In this way it is possible to avoid or reduce contamination of the embossing rollers in the storage unit by dust, splashes of glue or other contaminants that may be present in the embossing area, i.e. near the sides 3C, 3D. Furthermore, between the storage unit 51 and the sides 3C, 3D supporting the working rollers, a passage may be provided offering access to the storage unit 51 by an operator, or by a transfer device 65, described in greater detail below.

In some embodiments, as shown in FIGS. 1 to 4, between the storage unit 51 and the sides 3C, 3D of the fixed load-bearing structure 3, a pair of cross members 63 may be provided along which the transfer device 65 can move, in the direction of the arrow f65, said transfer device 65 being configured for transferring the embossing rollers from the sides 3C, 3D to the storage unit 51 and vice-versa. The transfer device 65 can move along guides 63A (FIG. 2) in the direction of a numerically controlled horizontal axis X. The transfer device 65 may also move in the direction of a numerically controlled vertical axis Z, as described in more detail below, so as to be able to move the embossing rollers in two directions orthogonal to one another.

By means of the cross members 63 and the movement along them by the transfer device in the direction of the arrow f65, the storage unit 51 can be placed at a certain distance from the embossing area (between the sides 3C, 3D), upstream thereof with respect to the direction of advancement of the plies V1, V2, V3, i.e. towards the unwinder (not shown) where the parent reels wherefrom the plies are located. The structure thus defined, comprising the cross members 63 suitably supported by the sides 3C, 3D, and the advantageously vertically extending storage unit 51, may in some cases also serve as a structural support element for guide rollers for the plies fed to the embossing device 1. Contrary to other known solutions, wherein the embossing rollers are held by a revolver transfer device, with an architecture of the type described, operation of the embossing device 1 is possible even if the transfer device 65 is broken down.

Placing the storage unit 51 upstream of the embossing area and at a certain distance therefrom allows for better access to the actual embossing device 1, contrary to what happens in known systems, where the embossing roller storage unit and the embossing area are superposed one above the other.

The architecture described makes it possible, for example, to access the embossing area and replace the embossing rollers using equipment other than the transfer device 65, if the transfer device is broken down, for example. The distance between the storage unit 51 and the embossing area makes it possible, if necessary, to access the embossing rollers located between the sides 3C, 3D by means of a bridge crane or other equipment external to the embossing device.

The seats 53 of the storage unit 51 are shaped with a curved lower portion so as to be able to hold end journals of the embossing rollers 55-59, 5, 7.

Some of the seats 53 of the storage unit 51 may be configured for receiving interchangeable cliché rollers 27. The transfer device 65 can be controlled and positioned to replace the temporarily operational cliché roller 27 with another cliché roller waiting in the storage unit 51. This is possible thanks to the way in which the transfer device 65 is mounted and moved with respect to the rest of the machine. In substance, there is obtained a system for the automatic replacement of cliché rollers, which may be useful, for example, when the embossing device 1 has to process plies V1-V3 of different widths, i.e. when there is a change of format. In this case, the cliché roller is replaced so that the axial length of the cylindrical working surface of the cliché roller is always roughly equal (or slightly less) than the width of the plies being processed.

Replacement of the cliché roller may also be useful when said roller does not have a continuous surface, but rather is designed to distribute glue according to a predetermined pattern. Automatic replacement of the cliché roller with the transfer device 65 allows for an easy change of the pattern according to which the glue is applied.

Figure 2:
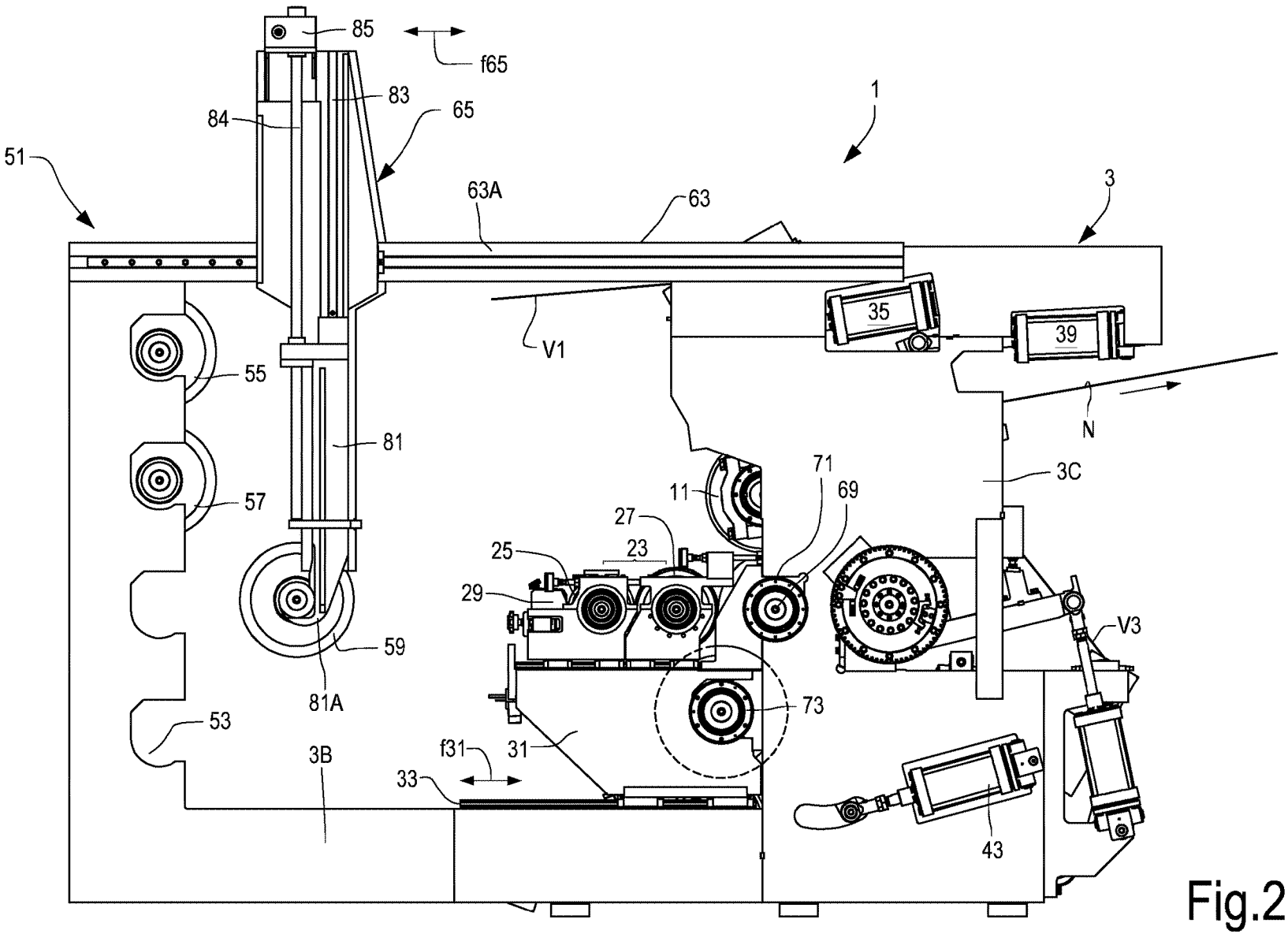
FIG. 2 shows a side view of the embossing device shown in FIG. 1.
Figure 3:
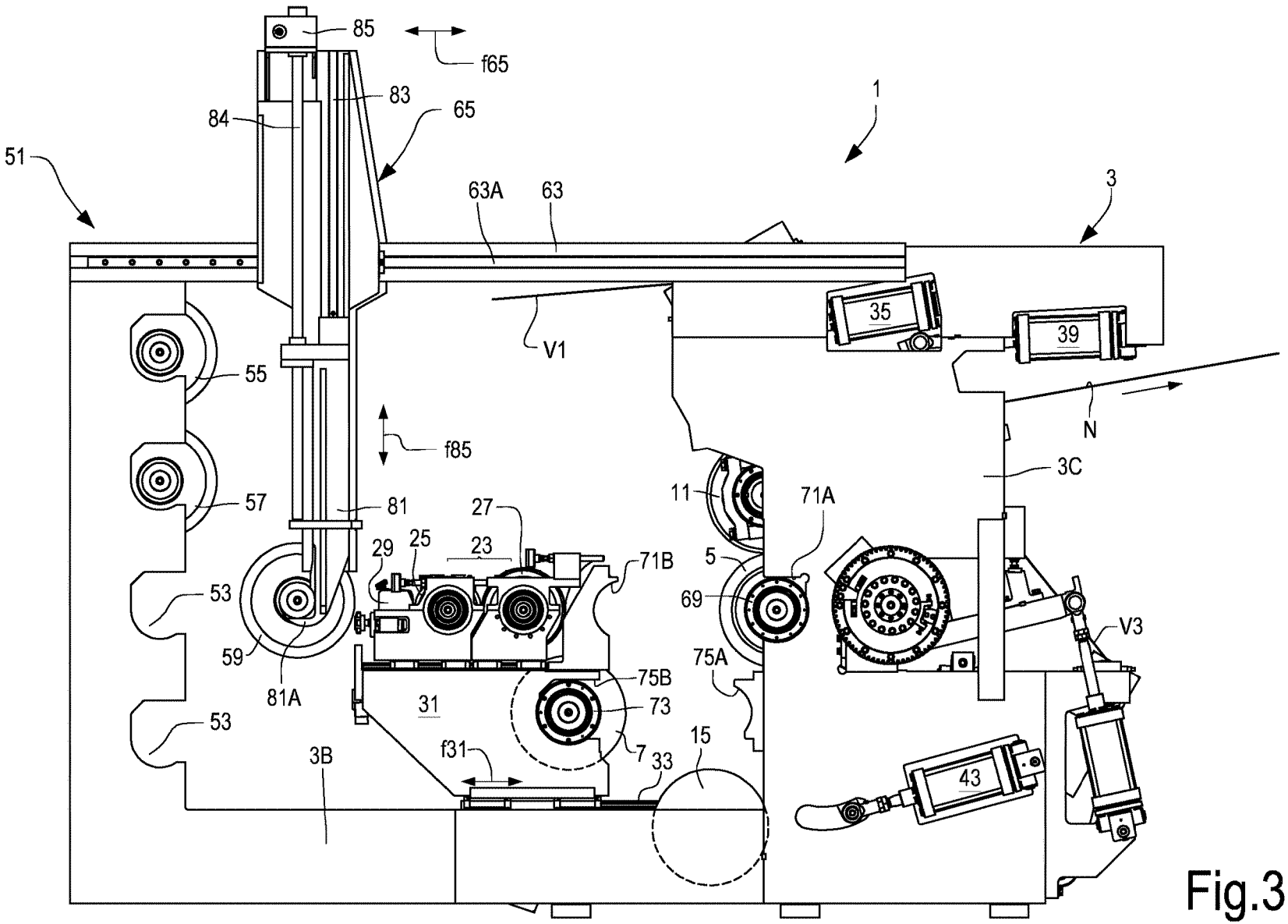
FIG. 3 shows a side view similar to that shown in FIG. 2, of the embossing device at an intermediate stage of an embossing roller replacement cycle.

To enable easy replacement of the embossing rollers 5 and 7, they are supported in seats that can be easily opened and closed. More specifically, as can be seen in FIGS. 2 and 3, the first embossing roller 5 is fitted with its own supporting bearings 69, in a pair of seats 71, only one of which is shown in FIGS. 2 and 3, while the other is located on the opposite side 3C. Each seat 71 has a portion 71A formed by the respective side 3C, 3D and a closure portion 71B carried by the movable unit 31, which also supports the glue dispenser 23. In this way, the seat 71 can be opened simply by moving the movable unit 31 away along the guides 33 of the sides 3C, 3D. The portion 71A formed by the side 3C or 3D has a curved lower shape that is long enough to form a cradle to hold the supporting bearing 69 of the embossing roller 5, without the latter falling as a result of the portion 71B of the seat moving away when the movable unit or trolley 31 is moved away from the pair of sides 3C, 3D.

In the embodiment shown, to simplify replacement thereof the second embossing roller 7 is supported by means of supporting bearings 73, in respective seats 75 formed by two portions 75A, 75B, similar to the portions 71A, 71B of the seat 71 that supports each supporting bearing 69 of the first embossing roller 5. In the embodiment shown, each seat of the second embossing roller 7 comprises a portion 75A solidly connected to the respective side 3C or 3D and a second portion 75B solidly connected to the movable unit 31. In this embodiment the portion 75B of each seat 75 of the supporting bearing 73 of the second embossing roller 7 has an angular extension greater than portion 75A and supports the respective supporting bearing 73 from below, so that when the movable unit 31 is moved away from the sides 3C, 3D of the load-bearing structure 3, taking the position shown in FIGS. 3 and 4, the second embossing roller 7 is held in the portion of seat 75B and moved away from the sides 3C, 3D moving as one with the movable unit 31 and therefore moving away from the first embossing roller 5 and from the pressure roller 15 underneath.

Advantageously, to facilitate this movement, the second pressure roller 15 can be lowered by the actuator 37, thus moving the cylindrical surfaces of the second pressure roller 15 and the second embossing roller 7 mutually away from one another. A similar movement can be imparted to the first pressure roller 11 to facilitate removal of the first embossing roller 5 from the seat portion 71A.

When the movable unit 31 is in the position shown in FIG. 3, the transfer device 65 can easily enter between the sides 3C, 3D and the movable unit 31 to take one or the other of the embossing rollers 5 and 7 and transfer them to the storage unit 51. Similarly, the same transfer device 65 can take any of the embossing rollers standing-by in the storage unit 51 to replace one or the other of the embossing rollers 5 and 7.

To that end, the transfer device 65 may comprise a pair of arms 81 vertically sliding along a numerically controlled vertical axis Z. This vertical movement may be guided along suitable guides 83 of the transfer device 65, in the direction of the double arrow f85. The arms 81 may end in hooks 81A that can engage the journals of the embossing rollers 5, 7, 55, 57, 59. A threaded bar 84 driven by a gear motor 85 can be used to move the arms 81 in the direction of the double arrow f85 for picking up and releasing the embossing rollers from the seats of the storage unit 51 and of the embossing device 1.

Figure 8:
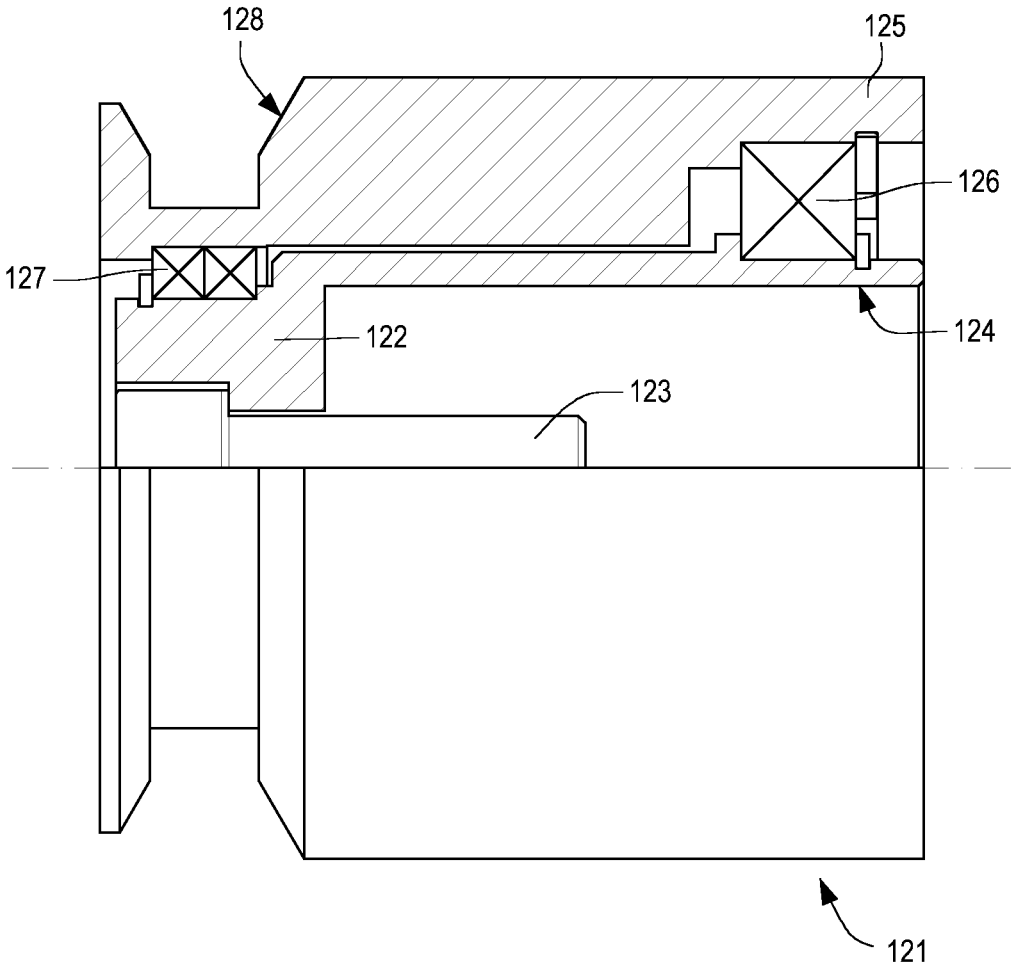
FIG. 8 shows a support element for the ends of the embossing rollers, to facilitate manipulation by a transfer device.

To facilitate engagement of the embossing rollers by the transfer device 65, the hooks 81A can interact with end support elements, mounted on the embossing roller journals. FIG. 8 shows a partial side view and a partial longitudinal cross-section of a possible embodiment of an end support element for this purpose, indicated as a whole by the reference number 121. In some embodiments the end support element 121 comprises an internal sleeve 122, with an axial cavity 124 into which the end of the respective embossing roller journal is introduced. Reference number 123 indicates a clamping screw for the sleeve 122 inside the journal of the respective embossing roller.

The end support element 121 may also have an external sleeve 125, coaxial with the internal sleeve 122. The external sleeve 125 may be swivelingly supported on the internal sleeve 122, for example by means of rolling bearings 126, 127. The internal sleeve 122 and the external sleeve 125 are mounted so as to be free to rotate with respect to one another, but are axially blocked to one another.

Figure 9:
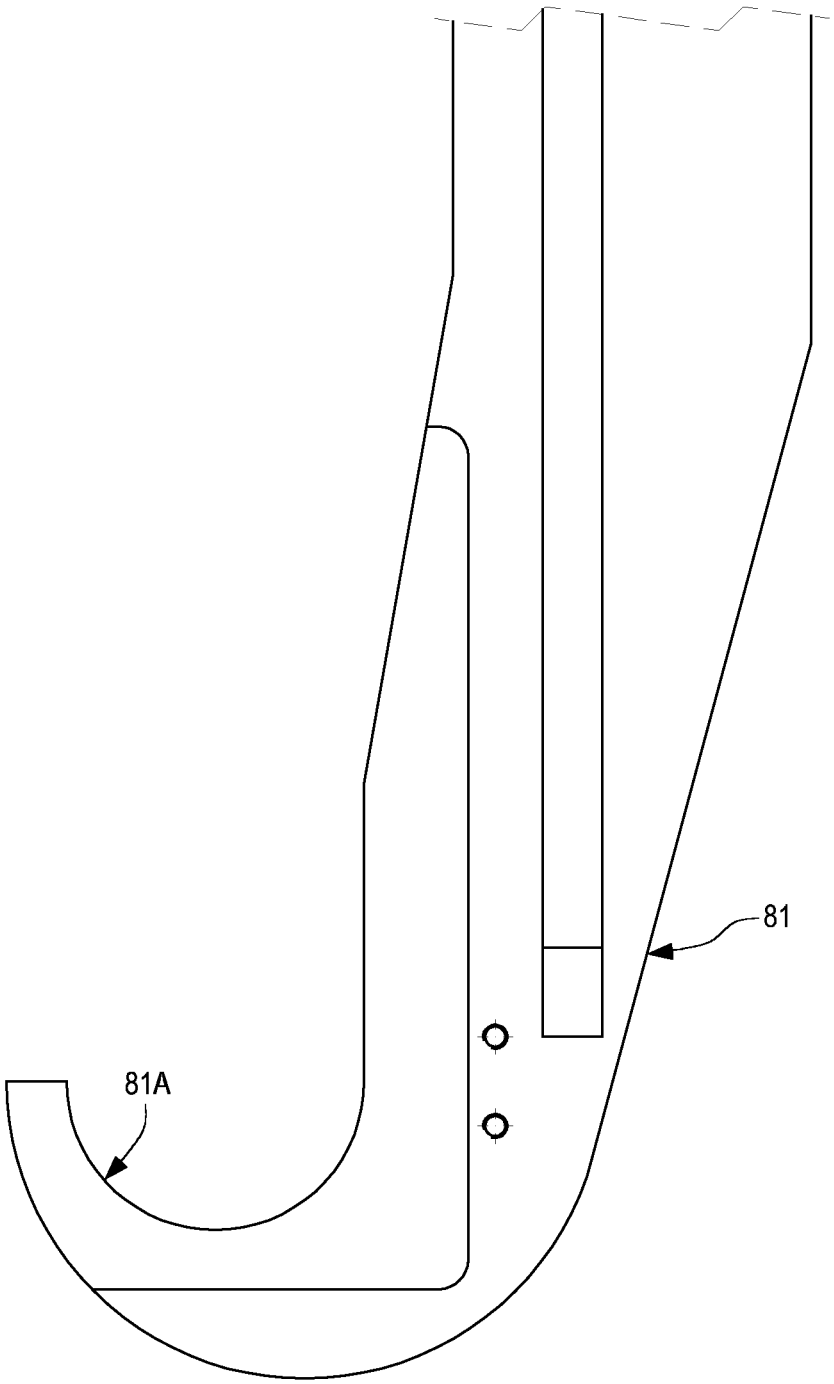
FIG. 9 shows a detail of the transfer device.

In the embodiment shown, the external sleeve 125 is provided with an annular groove 128 with large bevels for engaging the hook 81A with which each arm 81 of the transfer device 65 ends. The lower part of the arm 81 and associated hook 81A are shown in a side view in the enlargement shown in FIG. 9.

The end support element 121 allows precise centering of the hook 81A of the transfer device 65 in both a transversal and longitudinal direction, thanks to the bevels of the annular groove 128. Furthermore, the end support element 121 allows free rotation of the embossing roller on which the element is fitted, with respect to the hook 81A of the transfer device 65. This facilitates introduction of the embossing roller into the embossing device, and engagement between the teeth of a toothed wheel fitted onto the embossing roller (described below) and the respective transmission belt (also described below), or with a toothed wheel driving the embossing device.

In simplified embodiments, the internal sleeve 122 may be omitted and the external sleeve 125, on which the annular groove 128 is provided, may be mounted directly on the journal of the embossing roller with interposed bearings 126, 127, to allow rotation of the sleeve and the groove 128 with respect to the embossing roller journal.

The structure described enables easy replacement of the embossing rollers 5 and 7, while the third embossing roller 9 can be substantially immovable or in any case may be replaced by means of more complex operations, since its replacement may only be necessary from time to time.

To facilitate removal of the embossing rollers 5 and 7 and their replacement with one or other of the embossing rollers 55-59 present in the storage unit 51, according to advantageous embodiments a specific system for transmitting movement to the embossing rollers 5 and 7 is provided. Movement transmission is shown in detail in FIG. 4, which shows the side 3D of the embossing device 1 on which the motion transmission elements are placed.

Figure 4:
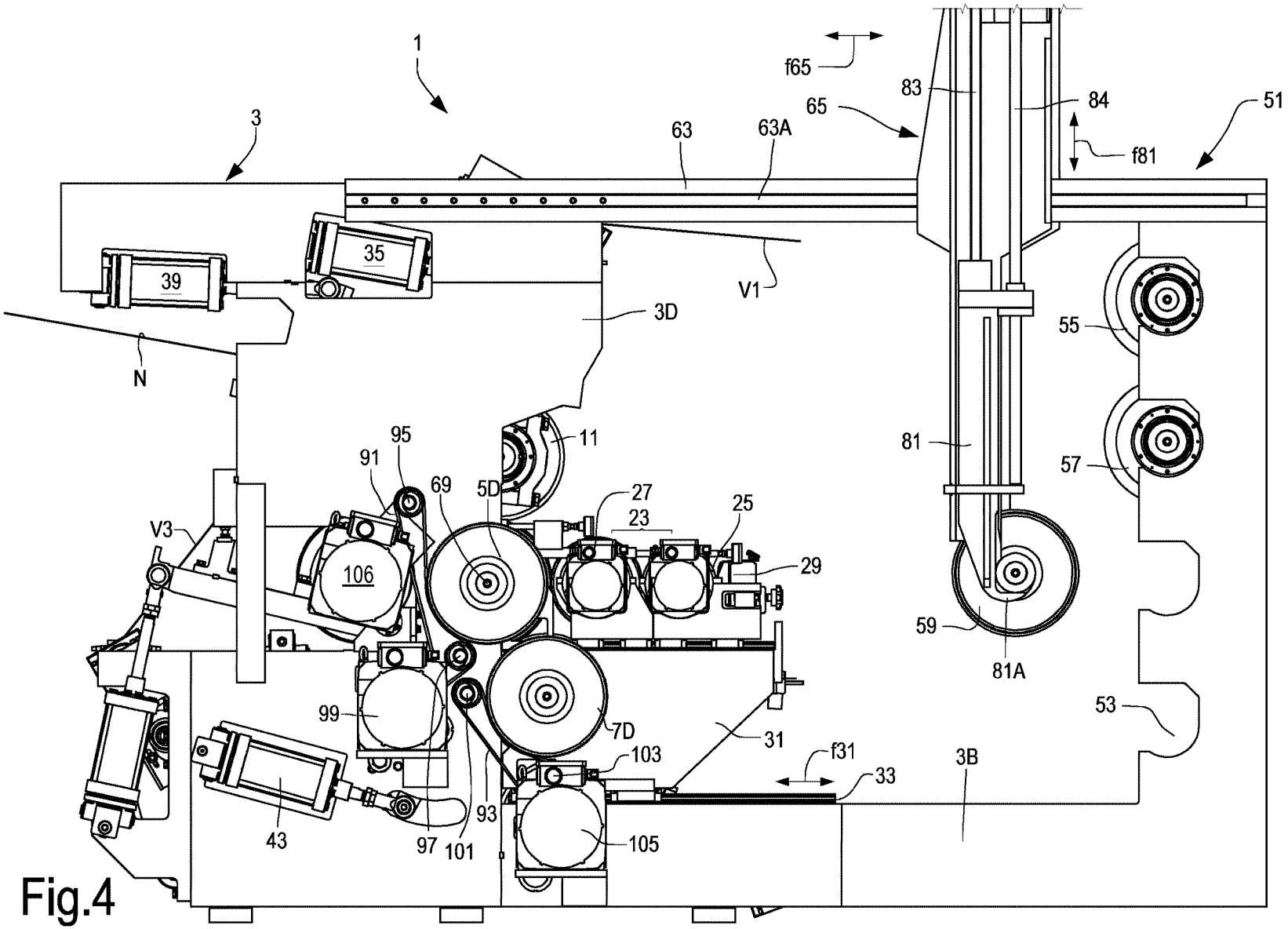
FIG. 4 shows a side view of the embossing device shown in FIG. 1, from the side opposite that shown in FIG. 2.

Each embossing roller is provided with a toothed wheel fitted onto one of the journals. The wheel remains mounted on the embossing roller when it is transferred from the storage unit 51 to the working area and vice-versa. In FIG. 4, reference numbers 5D and 7D indicate two toothed wheels fitted to the journals of the embossing rollers 5 and 7, respectively. The toothed wheels 5D and 7D receive the rotation movement which is then imparted to the embossing rollers 5 and 7. The rotation movement to the embossing roller 5 is transmitted to the toothed wheel 5D by means of a toothed belt 91, while the rotation movement to the toothed wheel 7D that rotates the second embossing roller 7 is imparted by means of a second toothed belt 93. The two toothed belts 91 and 93 can have a double toothed setup, i.e. they may be provided with two opposing faces, both of which are toothed. The outer face of the toothed belt 91 engages with the teeth of the toothed wheel 5D, while the outer face of the toothed belt 93 engages with the teeth of the crown ring or toothed wheel 7D. The internal teeth engage with driving wheels rotated by respective drive motors.

In particular, the toothed belt 91 is entrained around idle toothed wheels 95, 97 and around a driving toothed wheel, not shown, which is driven by a motor 99. Similarly, the toothed belt 93 is entrained around idle toothed wheels 101 and 103 and around a driving toothed wheel, not shown, that takes its movement from a second motor 105. The third embossing roller 9 may be rotated by a third motor 106. In this way, the three embossing rollers 5, 7, 9 are each provided with their own independent motor. The pressure rollers 11, 15, 19 and the lamination roller 41 can be rotated through contact with the respective embossing rollers.

Each of the two toothed belts 91 and 93 forms a closed path, and is configured so that the toothed wheels 5D and 7D fitted on the embossing rollers 5 and 7 can be moved away from the toothed belts 91 and 93 without the need to take off the belts, due to the fact that the engagement contact between the toothed wheels 5D and 7D and the toothed belts 91 and 93 takes place on the outer surface of the toothed belts, i.e. on the surfaces of the toothed belts 91 and 93 facing the outside of the respective closed paths formed by the toothed belts. As will be understood by comparing FIGS. 3 and 4, it becomes thus possible to remove the embossing rollers 5 and 7, to which the toothed wheels 5D and 7D are fitted, without interfering with the movement transmission members.

This makes it very easy to replace the first embossing roller 5 and the second embossing roller 7 with any one of the embossing rollers 55-59 present in the storage unit 51. Clearly, it is also possible to switch the position of roller 5 with roller 7 or vice-versa. As seen above with reference to FIG. 8, if the embossing roller is provided with an end support element 121, engagement between the toothed wheel 5D, 7D and the respective toothed belt 91, 93 is easier. The advantage of using an end support 121 may also be found in the case of geared movement transmission, instead of a toothed belt.

Figure 5C:
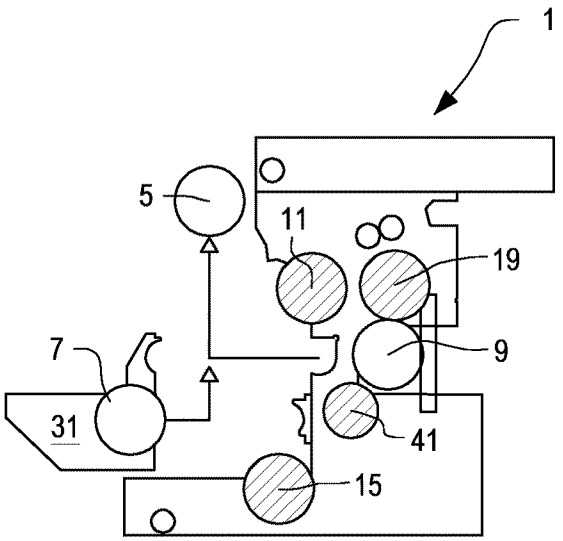
FIGS. 5A, 5B and 5C schematically show stages of replacing embossing rollers in an embossing device according to the invention.
Figure 5B:
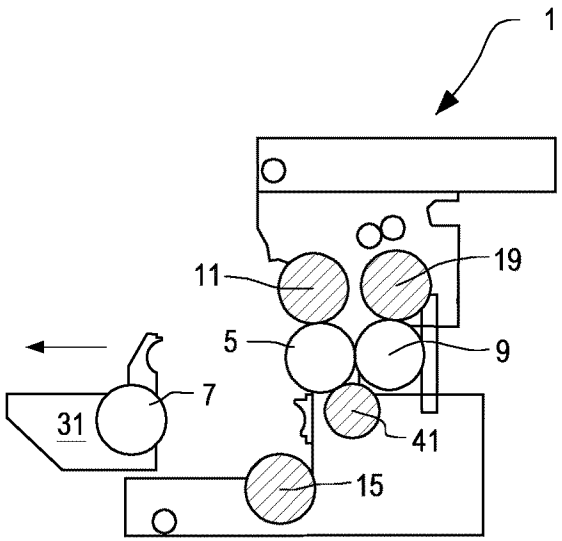
Figure 5A:
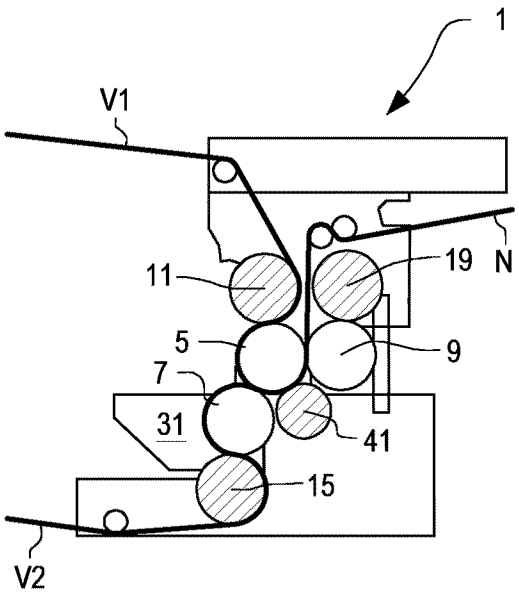

FIGS. 5A, 5B and 5C show in three steps the opening movements of the seats of the first embossing roller 5 and the second embossing roller 7 and the distancing movement of the embossing rollers 5 and 7 from the load-bearing structure 3 of the embossing device 1. These distancing movements are imparted to the embossing rollers 5 and 7 by the transfer device 65, the hooks 81A whereof can move along orthogonal axes formed by guides 63A and guides 83.

Having described the general structure of the embossing device 1, with reference to FIGS. 6A to 6F four operating modes of the embossing device 1 will now be illustrated, for manufacturing multi-ply web material N having different structures. FIGS. 6A-6F show only the embossing rollers 5, 7, 9, the pressure rollers 11, 15, 19, the glue dispenser 23 with its rollers 27 and 29 and the lamination roller 41, as well as the relative nips between the rollers. The remaining construction details of the embossing device 1, shown in FIGS. 1 to 4, are omitted.

FIGS. 6A to 6D also indicate the directions of rotation of the various rollers working in the different configurations. In some cases, one or more rollers may remain inactive. In the configuration shown in FIG. 6A, three plies V1, V2 and V3 are provided that, when properly embossed and bonded together, form a three-ply web material N. The ply V1 is embossed by the first embossing roller 5 and by the first pressure roller 11 in the first embossing nip 13. After being embossed, and while it is still adhering to the first embossing roller 5, the first ply V1 receives glue from the glue dispenser 23 on the protruding surfaces of the ply V1, before reaching the first transfer nip 6 for the embossed plies.

The second ply V2 is embossed by the second embossing roller 7 and by the second pressure roller 15 in the second embossing nip 17, and is then transferred from the second embossing roller 7 to the first embossing roller 5 in the first transfer nip 6 for the embossed plies V1 and V2.

Downstream of the first transfer nip 6 for the embossed plies, the two plies V1 and V2 are guided along the cylindrical surface of the first embossing roller 5 and through the lamination nip 45, where the first embossed ply V1 and the second embossed ply V2 are laminated between the first embossing roller 5 and the lamination roller 41, which is pressed against the embossing protuberances 5P of the first embossing roller 5. The plies V1 and V2 are thereby pressed against one another and caused to adhere to one another by the glue applied by the glue dispenser 23.

The third ply V3 is embossed between the third embossing roller 9 and the third pressure roller 19 in the third embossing nip 21 and is laminated or bonded to the first embossed ply V1 and to the second embossed ply V2 in the second transfer nip 47 for the embossed plies, formed between the first embossing roller 5 and the third embossing roller 9. The embossing protuberances 5P of the first embossing roller and the protuberances 9P of the third embossing roller can be configured and arranged so that in the transfer nip 47 at least some of the protuberances 5P of the first embossing roller 5 and at least some of the embossing protuberances 9P of the third embossing roller 9 are in a tip-to-tip configuration, i.e. pressed against one another. The pressure causes the glue applied by the glue dispenser 23 to bond the three plies V1, V2, V3 by seeping through the cellulose fibers that form them.

While the embossing rollers 5 and 9 may be configured so that the embossing protuberances 5P and 9P are in a tip-to-tip configuration in the second transfer nip 47 for the embossed plies, the embossing protuberances 5P of the first embossing roller and the embossing protuberances 7P of the second embossing roller 7 may be configured and arranged so that the embossed plies V1 and V2 are bonded in a nested configuration. In practice, the protrusions embossed by the second embossing roller 7 on the second ply V2 nest between the protrusions embossed by the first embossing roller 5 on the first ply V1.

FIG. 6B shows a schematic enlargement of a portion of the web material N obtained with the configuration of the embossing device 1 described with reference to FIG. 6A. In FIG. 6B, the reference letter C indicate the glue applied between the embossed plies V1, V2 and V3, while the reference numbers S1, S2 and S3 indicate embossed protrusions formed, respectively, on the plies V1, V2 and V3 by the embossing protuberances 5P, 7P and 9P of the first embossing roller 5, the second embossing roller 7 and the third embossing roller 9. The protrusions S2 are nested between adjacent protrusions S1, while the latter are in a tip-to-tip configuration with the protrusions S3.

FIG. 6C shows a different setup of the embossing device 1. The embossing, pressure and laminating rollers, as well as the glue dispenser, are indicated by the same reference numbers used above with reference to FIG. 6A and FIGS. 1 to 5 previously. In the setup shown in FIG. 6C, the embossing device 1 uses only the first embossing roller 5 and the third embossing roller 9, co-acting with the first pressure roller 11 and the third pressure roller 19, while the second embossing roller 7, the second pressure roller 15 and the lamination roller 41 are non-operational and may remain stationary, by having them moved away from the first embossing roller 5. In this setup the web material N is formed of only two plies V1 and V3.

The ply V1 is embossed between the first embossing roller 5 and the first pressure roller 11 in the first embossing nip 13 and receives the glue applied by the glue dispenser 23 on the head surfaces of the protrusions S1 formed on the ply V1. The ply V3 is embossed between the third embossing roller 9 and the third pressure roller 19 in the third embossing nip 21. In the second transfer nip 47 for the embossed plies, at least some of the protuberances 5P and 9P of the first embossing roller 5 and third embossing roller 9 are in a tip-to-tip arrangement similar to that described with reference to FIG. 6A, so as to laminate and bond plies V1 and V3 with one another by gluing front surfaces of the protrusions S1 and S3 formed on the plies. FIG. 6D shows a schematic enlargement of the web material obtained with this setup of the embossing device 1. The reference numbers S1 and S3 indicate the embossed protrusions formed on the plies V1 and V3, while the reference letter C indicates the glue placed between opposing protrusions S1 and S3.

While in FIG. 6D the protrusions S1 and S3 are of substantially the same size, in other embodiments embossing protuberances 5P and 9P of markedly different sizes can be used, for example to generate a decorative pattern, with large-size protrusions, on ply V1 and micro-embossing, for example formed by small protrusions and simple geometric forms (truncated-cone or truncated-pyramid) on ply V3. FIG. 6E shows a setup of this type, with protrusions S3 forming a base micro-embossing, bonded to protrusions S1 of a size larger than the protrusions S3.

Using an embossing roller 9 provided with a micro-embossing engraving to obtain protrusions S3 of the type shown in FIG. 6E, it is possible to vary at will the decorative pattern on ply V1, by simply replacing, as described above, the embossing roller 5 with one or another of the spare embossing rollers contained in the storage unit 51.

Figure 6F:
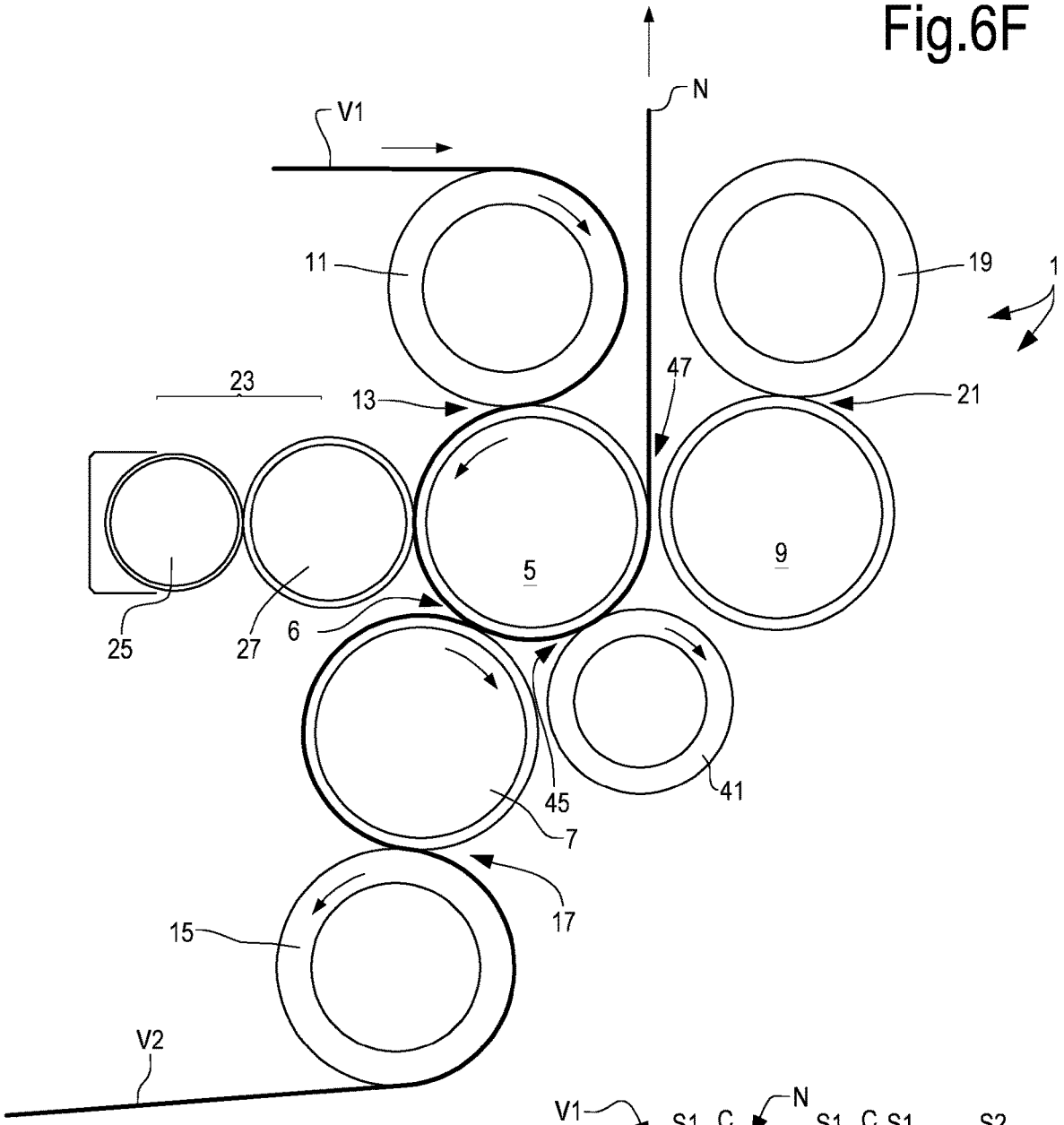
Figure 6G:
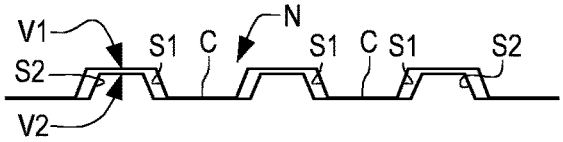

FIG. 6F shows a further setup of the embossing device 1 for producing a two-ply web material N in a nested configuration, instead of in a tip-to-tip configuration as shown in FIGS. 6C and 6E. FIG. 6G shows a schematic enlargement of a portion of web material N obtained by means of the configuration shown in FIG. 6F. In this setup, the third embossing roller 9 and the third pressure roller 19 are not operational. The third embossing roller 9 can be held at a distance from the first embossing roller 5, so as not to have to rotate. The third pressure roller 19 may also remain stationary. On the other hand, the first embossing roller 5, the first pressure roller 11, the second embossing roller 7 and the second pressure roller 15, together with the lamination roller 41, all rotate in the directions indicated by the respective arrows. By means of these rollers, a first ply V1 and second ply V2 are embossed, in the first embossing nip 13 and in the second embossing nip 17 respectively. The lamination roller 41 is also used to bond by lamination the first embossed ply V1 and the second embossed ply V2, between which glue has been applied by the glue dispenser 23.

The web material N thus obtained is shown schematically in FIG. 6G. It is a nested product, wherein embossed protrusions S2 formed by the second embossing roller 7 and by the second pressure roller 15 on the second ply V2 nest between embossed protrusions S1 formed on the first ply V1 by the first embossing roller 5 co-acting with the first pressure roller 11. The glue is applied by the glue dispenser 23 to the heads of the embossed protrusions S1 and the plies V1 and V2 are bonded by lamination between the first embossing roller 5 and the lamination roller 41.

Figure 6H:
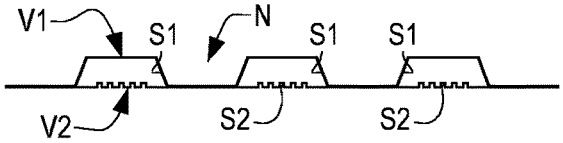

The embossing rollers that are used as second embossing rollers 7 may be provided with embossing protuberances 7P of a height substantially less than the embossing protuberances 5P of the first embossing roller and with much greater density, thereby forming a base micro-embossing. The embossed protrusions S2 formed on the second embossed ply V2 may in this case not penetrate between the embossed protrusions S1 formed on the first embossed ply V1, as shown schematically in FIGS. 6B, 6G, and may overly the embossed protrusions S1 formed on the first embossed ply V1 and be crushed by the lamination roller 41. This type of situation is shown schematically in FIG. 6H.

Figure 6I:
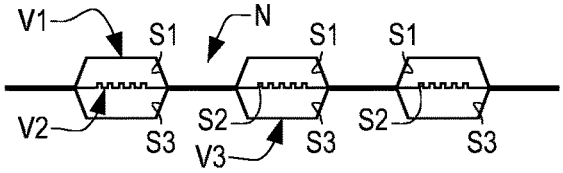

A third ply V3 may also be applied in a tip-to-tip arrangement to a web material N thus formed, as shown in FIG. 6I. The web material N shown in FIG. 6I may be obtained with a configuration of the type shown in FIG. 6A.

Figure 7A:
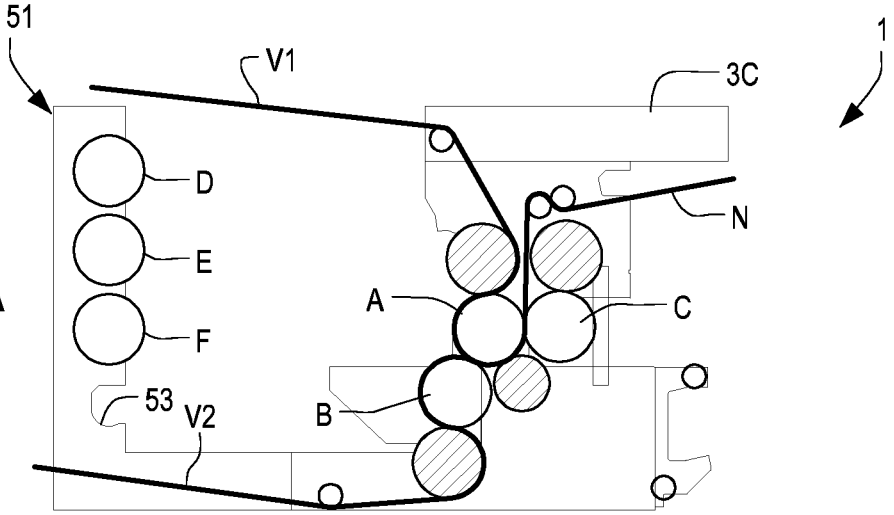
FIGS. 7A to 7C show various configurations and possibilities for changing the setup of an embossing device according to the invention.
Figure 7B:
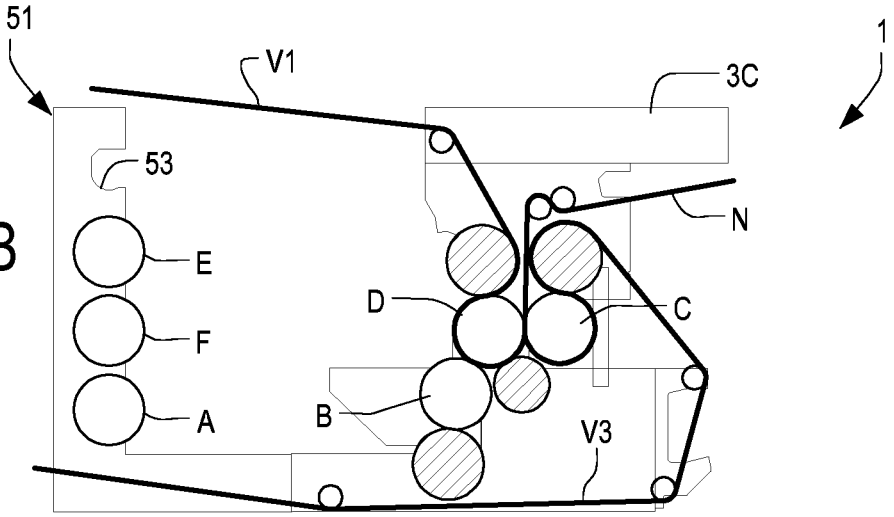
Figure 7C:
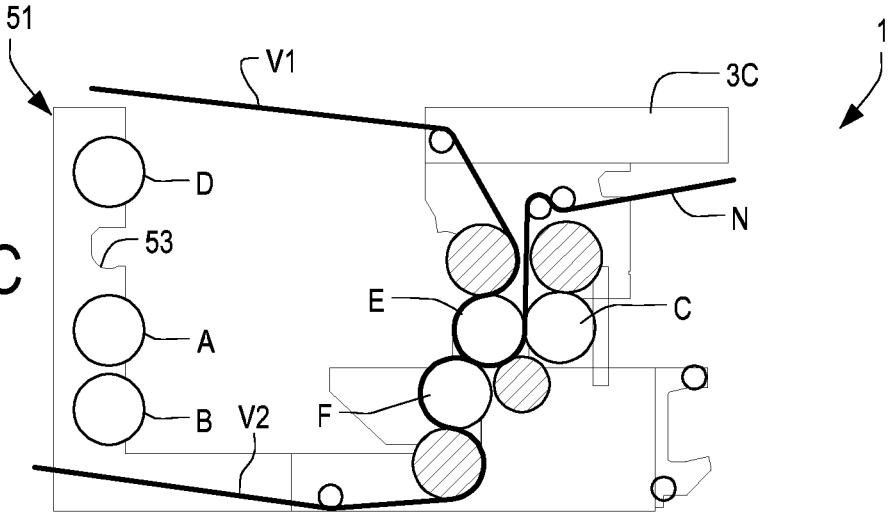

While FIGS. 6A to 6I describe various possible types of web products that can be obtained with the embossing device 1, the following FIGS. 7A-7C show some of the possibilities offered by the embossing device 1 when it comes to replacing individual embossing rollers, for example in order to change the embossing pattern of one or other of the plies V1, V2.

In each of the FIGS. 7A-7C, there are six embossing rollers that can be used alternatively and in different configurations. For a simpler description, the six embossing rollers, three mounted between the sides 3C, 3D of the embossing device 1 and three placed in the storage unit 51, are indicated by the letters A, B, C, D, E and F.

In the setup shown in FIG. 7A, embossing rollers A, B and C are mounted between the sides 3C, 3D of the embossing device 1. The product thus obtained, indicated by the letter N, is formed of two plies V1 and V2 and is a nested product of the type that can be obtained using the configuration shown in FIG. 6F. The third embossing roller, here indicated by the letter C, is not operational. Switching from the setup shown in FIG. 7A to the setup shown in FIG. 7B, the first embossing roller A has been replaced, and has been placed in the storage unit 51, and in its place embossing roller D has been mounted, which in FIG. 7A was shown in the storage unit 51. The web material N produced in this setup is a tip-to-tip type web material (as shown in FIG. 6C) obtained by bonding the plies V1 and V3.

In FIG. 7C both the first embossing roller and the second embossing roller have been replaced. Rollers E and F are located between the sides 3C, 3D, together with roller C, which in these examples is never replaced. Roller D used in the setup shown in FIG. 7B has been repositioned in the storage unit, where there are also rollers A and B used previously in the setup shown in FIG. 7A. The product obtained is still the one shown in FIG. 6F, but with different patterns, since both the first embossing roller and the second embossing roller have been replaced.

The embossing roller C, corresponding to the third embossing roller described above, is not operational.

In the various roller replacements described above, in order to find the correct synchronization between embossing rollers, it is sufficient to refer to the toothed wheels solidly fitted onto the roller rotation journals. References may be provided on the toothed wheels enabling the embossing rollers co-acting with one another to be correctly synchronized (for example tip-to-tip or nested).

In other possible configurations, the first embossing roller 5 and the second embossing roller 7 may be arranged in a "random" manner, instead of being nested.

The above description specifically concerns features of the embossing device aimed at providing enhanced flexibility, specifically with reference to the setting-up of the embossing device and switching thereof from one mode of operation to another.

However, some of the improving features disclosed herein can also be embodied in embossing devices having a different layout, for instance a different number and arrangement of the embossing rollers.

More specifically, according to a further aspect, the present disclosure concerns an embossing device 1 for producing a multi-ply web material N having at least two embossed plies V1, V2, comprising:

- a first embossing roller 5 provided with first embossing protuberances 5P;
- a first pressure roller 11, forming with the first embossing roller 5 a first embossing nip 13 configured for receiving and embossing a first ply V1 with first embossed protrusions S1 of a first embossing pattern defined by the first embossing protuberances 5P;
- a second embossing roller 7 provided with second embossing protuberances 7P;
- a second pressure roller 15, forming with the second embossing roller 7 a second embossing nip 17 configured for receiving and embossing a second ply V2 with second embossed protrusions S2 of a second embossing pattern defined by the second embossing protuberances 7P.

According to preferred embodiments, said embossing device further includes a glue dispenser 23 co-acting with the first embossing roller 5 for applying glue C to embossed protrusions S1 of the first ply V1 when the first ply V1 is in contact with the first embossing roller 5.

The first embossing roller 5 is supported in first seats 71 of the embossing device 1. Each first seat has a movable portion 71B, configured for taking, with respect to a fixed portion 71A of the respective seat 71, a retention position of the first embossing roller 5 and an open position, in which the first embossing roller 5 can be removed from the first seats 71. Moreover, the second embossing roller 7 can in turn be supported in second seats 75 of the embossing device 1. Each second seat can have a movable portion 75B, configured for taking, with respect to a fixed portion 75A of the respective seat 75, a retention position of the second embossing roller 7 and an open position, in which the second embossing roller 7 can be removed from the second seats 75. In this arrangement, according to some embodiments, the movable portions 71B of the first seats 71 and the movable portions 75B of the second seats 75 are supported by a common movable unit 31, for simultaneously opening and closing the first seats 71 an the second seats 75 by means of a displacement of said movable unit 31. As disclosed herein, the movable unit can in turn support the glue dispenser 23.

According to further embodiments, the movable portions 71B of the first seats 71 are mounted on a movable unit 31, which supports the glue dispenser 23, so that a displacement of the movable unit 31 causes a distancing or approaching movement of the glue dispenser 23 with respect to the first embossing roller 5 and simultaneous opening or closing movement of the first seats 71.

If the second seats 75 supporting the second embossing roller 7 are provided with movable and stationary seat portions as set forth above, according to yet further embodiments, the movable portions 75B of the second seats 75 are mounted on a movable unit 31, which supports the glue dispenser 23, so that a displacement of the movable unit 31 causes a distancing or approaching movement of the glue dispenser 23 with respect to the first embossing roller 5 and simultaneous opening or closing movement of the second seats 75.

The movable portions of the second seats can be arranged on the movable unit supporting the gluing dispenser 23 along with the movable portions of the first seats. In other embodiments, only the movable portions of the second seats can be mounted on the movable unit supporting the glue dispenser 23 and the movable portions of the first seats can be mounted on a separate movable unit.

According to some embodiments, the fixed portion 71A of each first seat 71 is configured for retaining therein the first embossing roller 5 when the respective movable portion 71B is moved away from the fixed portion 71A of the first seat 71.

Moreover, embodiments may be provided, wherein the movable portion 75B of each second seat 75 is configured for retaining therein the second embossing roller 7 when the movable portion 75B is moved away from the fixed portion 75A of the second seat 75, moving the second embossing roller 7 along with the movable portion 75B of the second seat 75.

The invention claimed is:

1. An embossing device (1) for producing a multi-ply web material (N) having at least two embossed plies (V1, V2; V3) bonded by gluing, comprising:

- a first embossing roller (5) provided with first embossing protuberances (5P);
- a first pressure roller (11), configured for forming with the first embossing roller (5) a first embossing nip (13) configured for receiving and embossing a first ply (V1) with first embossed protrusions (S1) of a first embossing pattern defined by the first embossing protuberances (5P);
- a glue dispenser (23) co-acting with the first embossing roller (5) for applying glue (C) to embossed protrusions (S1) of the first ply (V1) when the first ply (V1) is in contact with the first embossing roller (5);

a second embossing roller (7) provided with second embossing protuberances (7P);

a second pressure roller (15), configured for forming with the second embossing roller (7) a second embossing nip (17) configured for receiving and embossing a second ply (V2) with second embossed protrusions (S2) of a second embossing pattern defined by the second embossing protuberances (7P); wherein the first embossing roller (5) and the second embossing roller (7) are configured for forming a first transfer nip (6) for the passage of embossed plies (V1 V2);

a lamination roller (41) configured for co-acting with the first embossing roller (5) and configured for laminating the first ply (V1) and the second ply (V2) between the lamination roller (41) and the first embossing protuberances (5P) of the first embossing roller (5);

a third embossing roller (9) provided with third embossing protuberances (9P);

a third pressure roller (19), configured for forming with the third embossing roller (9) a third embossing nip (21) configured for receiving and embossing a third ply (V3) with third embossed protrusions (S3) of a third embossing pattern defined by the third embossing protuberances (9P); wherein the third embossing roller (9) and the first embossing roller (5) are configured for forming a second transfer nip (47) for the passage of embossed plies (V1, V2, V3).

2. The embossing device (1) of claim 1, wherein at least one of said second embossing roller (7) and third embossing roller (9) is configured to be selectively brought in an active position and in an inactive position.

3. The embossing device (1) of claim 1, wherein the first embossing roller (5) an the third embossing roller (9) are configured and arranged such that at least part of the first embossing protuberances (5P) are in a tip-to-tip engagement with at least part of the third embossing protuberances (9P).

4. The embossing device (1) of claim 1, wherein the first embossing roller (5) and the second embossing roller (7) are configured and arranged such that at least part of the first embossing protuberances (5P) and of the second embossing protuberances (7P) are positioned in a nested or random configuration.

5. The embossing device (1) of claim 1, wherein the first embossing roller (5) is supported in first seats (71) of the embossing device (1); wherein each first seat has a movable portion (71 B), configured for taking, with respect to a fixed portion (71A) of the respective seat (71), a retention position of the first embossing roller (5) and an open position, in which the first embossing roller (5) is removable from the first seats (71).

6. The embossing device (1) of claim 5, wherein the second embossing roller (7) is supported in second seats (75) of the embossing device (1); wherein each second seat has a movable portion (75B), configured for taking, with respect to a fixed portion (75A) of the respective seat (75), a retention position of the second embossing roller (7) and an open position, in which the second embossing roller (7) is removable from the second seats (75).

7. The embossing device (1) of claim 5, wherein the movable portions (71B) of the first seats (71) and the movable portions (75B) of the second seats (75) are supported by a common movable unit (31), for simultaneously opening and closing the first seats (71) an the second seats (75) by means of a displacement of said movable unit (31).

8. The embossing device (1) of claim 5, wherein the movable portions (71B) of the first seats (71) are mounted on a movable unit (31), which supports the glue dispenser (23), so that a displacement of the movable unit (31) causes a distancing or approaching movement of the glue dispenser (23) with respect to the first embossing roller (5) and simultaneous opening or closing movement of the first seats (71).

9. The embossing device (1) of claim 6, wherein the movable portions (75B) of the second seats (75) are mounted on a movable unit (31), which supports the glue dispenser (23), so that a displacement of the movable unit (31) causes a distancing or approaching movement of the glue dispenser (23) with respect to the first embossing roller (5) and simultaneous opening or closing movement of the second seats (75).

10. The embossing device (1) of claim 5, wherein the fixed portion (71A) of each first seat (71) is configured for retaining therein the first embossing roller (5) when the respective movable portion (71B) is moved away from the fixed portion (71A) of the first seat (71).

11. The embossing device (1) of claim 6, wherein the movable portion (75B) of each second seat (75) is configured for retaining therein the second embossing roller (7) when the movable portion (75B) is moved away from the fixed portion (75A) of the second seat (75), moving the second embossing roller (7) along with the movable portion (75B) of the second seat (75).

12. The embossing device (1) of claim 1, wherein the first embossing roller (5) is driven into rotation by a first flexible endless member (91), guided along a closed path and having an inner surface facing an interior of the closed path and an outer surface facing an exterior of the closed path; and wherein the outer surface of the first flexible endless member (91) is in motion transmission contact with a first driving wheel (5D), coupled to the first embossing roller (5) to rotate therewith.

13. The embossing device (1) of claim 12, wherein the second embossing roller (7) is driven into rotation by a second flexible endless member (93), guided along a closed path and having an inner surface facing an interior of the closed path and an outer surface facing an exterior of the closed path; and wherein the outer surface of the second flexible endless member (93) is in motion transmission contact with a second driving wheel (7D), coupled to the second embossing roller (7) to rotate therewith.

14. The embossing device (1) of claim 1, comprising a transfer device (65) for replacing the first embossing roller (5) or the second embossing roller (7).

15. The embossing device (1) of claim 14, wherein the transfer device (65) is provided with a controlled movement along two translation axes orthogonal to one another comprising a horizontal axis and a vertical axis.

16. The embossing device (1) of claim 14, comprising a storing unit (51) for embossing rollers (55, 57 59).

17. The embossing device (1) of claim 16, wherein the storing unit (51) has a substantially vertical development and is provided with seats (53) for receiving mutually superposed embossing rollers (55, 57, 59, 5, 7).

18. The embossing device (1) of claim 1, comprising a fixed structure (3) having a base (3B), whereto a pair of supporting sides (3C, 3D) and a storing unit (51) for embossing rollers (55, 57, 59) are constrained, and wherein translation guides (63A) for a transfer device (65) are arranged between the supporting sides (3C, 3D) and the embossing rollers storing unit (51), the transfer device configured for transferring embossing rollers (55, 57, 59, 5, 9) from the storing unit (51) to embossing roller seats (71, 75) associated to said supporting sides (3C, 3D) and vice-versa.

19. The embossing device (1) of claim 18, wherein the storing unit (51) is arranged upstream of the supporting sides (3C, 3D) with respect to an advancement direction of the plies (V1, V2, V3).

20. The embossing device (1) claim 1, wherein the first and second embossing rollers (5, 7, 9) are provided with sleeves (125) idly mounted on supporting journals of the respective embossing roller and provided with an annular groove (128) configured to co-act with engaging and moving members (81A) of a transfer device (65) configured for transferring embossing rollers (55, 57, 59, 5, 9) from an embossing roller storing unit (51) to embossing roller seats (71, 75) in an embossing area of said embossing device (1) and vice-versa.

21. A method for converting an embossing device (1) from a first configuration to a second configuration, comprising:

(A) providing an embossing system in a first configuration, comprising:

a first embossing roller (5) provided with first embossing protuberances (5P);

a first pressure roller (11), forming with the first embossing roller (5) a first embossing nip (13) configured for receiving and embossing a first ply (V1) with a first embossing pattern (S1) defined by the first embossing protuberances (5P);

a glue dispenser (23) co-acting with the first embossing roller (5) for applying glue (C) to embossed protrusions (S1) of the first ply (V1) when the first ply (V1) is in contact with the first embossing roller (5);

a second embossing roller (7) provided with second embossing protuberances (7P);

a second pressure roller (15), forming with the second embossing roller (7) a second embossing nip (17) configured for receiving and embossing a second ply (V2) with a second embossing pattern (S2) defined by the second embossing protuberances (7P); wherein the first embossing roller (5) and the second embossing roller (7) form a first transfer nip (6) for the passage of embossed plies (V1 V2);

a lamination roller (41) co-acting with the first embossing roller (5) and configured for laminating the first ply (V1) and the second ply (V2) between the lamination roller (41) and the first embossing protuberances (5P) of the first embossing roller (5);

a third embossing roller (9) provided with third embossing protuberances (9P) and co-acting with a third pressure roller (19), forming with the third embossing roller (9) a third embossing nip (21) configured for receiving and embossing a third ply (V3) with a third embossing pattern (S3) defined by the third embossing protuberances (9P); wherein the third embossing roller (9) and the first embossing roller (5) form a second transfer nip (47) for the passage of embossed plies (V1, V2, V3);

(B) replacing the first embossing roller (5) with an alternative embossing roller (55-59); comprising:

temporarily moving the first pressure roller (11) away from a working position in contact with the first embossing roller (5);

removing the first embossing roller (5) from the embossing system;

introducing the alternative embossing roller (55-59) in the position previously taken by the first embossing roller (5) in the embossing system; and placing the first pressure roller (11) back in the working position, in contact with the alternative embossing roller (55-59), forming the first embossing nip (13) therewith.

22. The method of claim 21, comprising converting the embossing device (1) from a nested configuration to a tip-to-tip configuration by replacing said first embossing roller (5).

23. A method for converting an embossing device (1) from a first configuration to a second configuration, comprising:

(A) providing an embossing system in a first configuration, comprising:

a first embossing roller (5) provided with first embossing protuberances (5P);

a first pressure roller (11), forming with the first embossing roller (5) a first embossing nip (13) configured for receiving and embossing a first ply (V1) with a first embossing pattern (S1) defined by the first embossing protuberances (5P);

a glue dispenser (23) co-acting with the first embossing roller (5) for applying glue (C) to embossed protrusions (S1) of the first ply (V1) when the first ply (V1) is in contact with the first embossing roller (5);

a second embossing roller (7) provided with second embossing protuberances (7P);

a second pressure roller (15), forming with the second embossing roller (7) a second embossing nip (17) configured for receiving and embossing a second ply (V2) with a second embossing pattern (S2) defined by the second embossing protuberances (7P); wherein the first embossing roller (5) and the second embossing roller (7) form a first transfer nip (6) for the passage of embossed plies (V1 V2);

a lamination roller (41) co-acting with the first embossing roller (5) and configured for laminating the first ply (V1) and the second ply (V2) between the lamination roller (41) and the first embossing protuberances (5P) of the first embossing roller (5);

a third embossing roller (9) provided with third embossing protuberances (9P) and co-acting with a third pressure roller (19), forming with the third embossing roller (9) a third embossing nip (21) configured for receiving and embossing a third ply (V3) with a third embossing pattern (S3) defined by the third embossing protuberances (9P); wherein the third embossing roller (9) and the first embossing roller (5) form a second transfer nip (47) for the passage of embossed plies (V1, V2, V3);

(B) replacing the second embossing roller (7) with an alternative embossing roller (55-59); comprising:

temporarily moving the second pressure roller (15) away from a working position in contact with the second embossing roller (7);

removing the second embossing roller (7) from the embossing system;

introducing the alternative embossing roller (55-59) in the position previously taken by the second embossing roller (7) in the embossing system;

moving the second pressure roller (15) back in the working position, in contact with the alternative embossing roller (55-59), forming the second embossing nip (17) therewith.

24. The method of claim 21, comprising converting the embossing device (1) from a nested configuration to a different nested configuration by replacement of at least one of said first embossing roller (5) and second embossing roller (7), while the third embossing roller remains inactive.

25. The method of claim 21, wherein the first embossing roller (5) or the second embossing roller (7) or both the first embossing roller (5) and the second embossing roller (7) are supported in openable seats (71, 75) of a stationary structure, each seat comprising two portions (71A, 71B; 75A, 75B) that move apart and towards each other to open and close the respective seat; and wherein the removing of the first embossing roller (5) or the second embossing roller (7) from the embossing system comprises opening the seats (71, 75) of the embossing roller to be replaced.

26. The method of claim 21, wherein the embossing rollers (5, 7, 9; 55, 57 59) that are temporarily not in use are retained in a storing unit (51) of the embossing device (1).

27. The method of claim 26, wherein the embossing rollers are transferred from the embossing system to the storing unit (51) by means of a transfer device (65) that is movable according to two translation axes that are orthogonal to one another, wherein the storing unit is supported on a base (3B) on which supporting sides (3C, 3D) for supporting the rollers of the embossing system are mounted.

28. The method of claim 26, further comprising replacing a glue applicator roller (27) in the embossing system with a different glue applicator roller from the storing unit (51).

* * * * *